US008211610B2

(12) United States Patent
Yamaguchi et al.

(10) Patent No.: US 8,211,610 B2
(45) Date of Patent: Jul. 3, 2012

(54) CARRIER FOR USE IN DEVELOPER DEVELOPING ELECTROSTATIC IMAGE, DEVELOPER USING THE CARRIER, AND IMAGE FORMING METHOD AND APPARATUS AND PROCESS CARTRIDGE USING THE DEVELOPER

(75) Inventors: Kimitoshi Yamaguchi, Numazu (JP); Minoru Masuda, Numazu (JP); Yutaka Takahashi, Yokohama (JP); Koichi Sakata, Shizuoka-ken (JP); Hitoshi Iwatsuki, Numazu (JP); Toyoaki Tano, Numazu (JP)

(73) Assignee: Ricoh Company Limited, Tokyo (JP)

( * ) Notice: Subject to any disclaimer, the term of this patent is extended or adjusted under 35 U.S.C. 154(b) by 302 days.

(21) Appl. No.: 12/714,848

(22) Filed: Mar. 1, 2010

(65) Prior Publication Data

US 2010/0239975 A1 Sep. 23, 2010

(30) Foreign Application Priority Data

Mar. 18, 2009 (JP) ..... 2009-065416

(51) Int. Cl.
*G03G 9/00* (2006.01)

(52) U.S. Cl. ..... 430/111.35; 430/111.1; 430/111.3; 430/111.31; 430/123.4

(58) Field of Classification Search ..... 430/111.1, 430/111.3, 111.31, 111.35, 123.4
See application file for complete search history.

(56) References Cited

U.S. PATENT DOCUMENTS 4,590,141 A 5/1986 Aoki et al.
5,652,079 A * 7/1997 Mochizuki et al. ..... 430/111.1
5,731,120 A 3/1998 Tanigami et al.
6,472,118 B1 10/2002 Yamaguchi et al.
6,599,672 B2 7/2003 Yamaguchi et al.
6,739,534 B2 5/2004 Yamaguchi et al.
6,743,558 B2 6/2004 Yamaguchi et al.
6,828,075 B2 12/2004 Suzuki et al.
6,939,654 B2 9/2005 Kotsugai et al.
7,192,679 B2 3/2007 Yamaguchi et al.
7,320,852 B2 1/2008 Kotsugai et al.
2006/0210905 A1 9/2006 Imahashi et al.
2007/0048652 A1 3/2007 Imahashi et al.

(Continued)

FOREIGN PATENT DOCUMENTS

CN 101351747 A 1/2009

(Continued)

OTHER PUBLICATIONS

Office Action issued Oct. 19, 2011 in China Application No. 201010143728.1.

*Primary Examiner* — Mark F Huff
*Assistant Examiner* — Stewart Fraser
(74) *Attorney, Agent, or Firm* — Oblon, Spivak, McClelland, Maier & Neustadt, L.L.P.

(57) ABSTRACT

The carrier includes a particulate core material having magnetism; and a resin layer located on the surface of the particulate core material. The resin layer is prepared by forming a layer including a copolymer, which includes a unit (A) having a specific acrylic siloxane structure, a unit (B) having a specific acrylic silicone structure having a crosslinking ability, and a unit (C) having a specific acrylic structure in a specific ratio, on the particulate core material, and then subjecting the layer to a heat treatment to crosslink the layer.

12 Claims, 4 Drawing Sheets

U.S. PATENT DOCUMENTS

| | | | |
|---|---|---|---|
| 2007/0243482 | A1 | 10/2007 | Yamaguchi et al. |
| 2008/0063969 | A1 | 3/2008 | Yamaguchi et al. |
| 2008/0073252 | A1 | 3/2008 | Yamaguchi et al. |
| 2008/0227004 | A1 | 9/2008 | Yamaguchi et al. |
| 2009/0092920 | A1 | 4/2009 | Nagayama et al. |
| 2009/0123186 | A1 | 5/2009 | Sugiura et al. |

FOREIGN PATENT DOCUMENTS

| | | |
|---|---|---|
| JP | 55-127569 | 10/1980 |
| JP | 55-157751 | 12/1980 |
| JP | 56-140358 | 11/1981 |
| JP | 57-96355 | 6/1982 |
| JP | 57-96356 | 6/1982 |
| JP | 58-207054 | 12/1983 |
| JP | 61-110161 | 5/1986 |
| JP | 62-273576 | 11/1987 |
| JP | 8-305090 | 11/1996 |
| JP | 2005-49478 | 2/2005 |

* cited by examiner

CARRIER FOR USE IN DEVELOPER DEVELOPING ELECTROSTATIC IMAGE, DEVELOPER USING THE CARRIER, AND IMAGE FORMING METHOD AND APPARATUS AND PROCESS CARTRIDGE USING THE DEVELOPER

BACKGROUND OF THE INVENTION

1. Field of the Invention

The present invention relates to a carrier for use in two component developers used for electrophotography and electrostatic recording. The present invention also relates to a developer for developing electrostatic latent images, which uses the carrier. Further, the present invention relates to an image forming method, an image forming apparatus, and a process cartridge, which form a visual image using the developer.

2. Discussion of the Background

In dry developing methods used for electrophotography and electrostatic recording to visualize electrostatic latent images, a powder toner, which has been charged by friction with a frictional charge imparting member, is electrostatically adhered to an electrostatic latent image, resulting in formation of a visual image.

Such dry developing methods are broadly classified into one component developing methods using a one component developer including a toner as a main component, and two component developing methods using a two component developer including a mixture of a toner and a carrier such as glass beads, particulate magnetic materials, and coated carriers including core particles whose surface is coated with a resin or the like.

In such two component developers, toner particles are born on the surface of carrier particles by an electric force caused by friction therebetween.

When a two component developer approaches an electrostatic latent image, toner particles in the developer are attracted to the electrostatic latent image by the electric field formed by the electrostatic latent image because the electric field overcomes the bonding force of the toner particles, thereby forming a visual image (toner image) on the electrostatic latent image. This developer is repeatedly used while the toner is added thereto to compensate for the toner used for development.

Therefore, carrier is required to have such a surface as not to be easily contaminated with toner, which has a charge with a polarity opposite to that of the carrier, so that the carrier can be used for a long period of time while maintaining the frictional charging ability thereof.

However, due to collision of carrier particles and mechanical agitation in a developing device, and generation of heat caused by such collision and agitation, a spent toner problem in that the toner is fixed to the surface of the carrier particles and thereby the charging ability of the carrier particles is deteriorated with time is caused.

In attempting to prolong the life of carrier by preventing occurrence of the spent toner problem, published unexamined Japanese patent applications Nos. (hereinafter referred to as JP-As) 55-127569, 55-157751, 56-140358, 57-96355, 57-96356, 58-207054, 61-110161 and 62-273576 have proposed techniques such that the surface of core particles of carrier is coated with a resin having a low surface energy such as fluorine-containing resins and silicone resins.

Specifically, JP-A 55-127569 discloses a carrier covered with a layer including a room temperature crosslinking silicone resin and a positively chargeable nitrogen-containing resin. JP-A 55-157751 discloses a carrier coated with a material including at least one kind of modified silicone resin. JP-A 56-140358 discloses a carrier covered with a resin layer including a room temperature crosslinking silicone resin and a styrene-acrylic resin. JP-A 57-96355 discloses a carrier prepared by forming two or more cover layers on the surface of core particles, wherein the cover layers have poor adhesiveness to each other at the interfaces therebetween. JP-A 57-96356 discloses a carrier covered with a layer including a polyvinyl acetal resin crosslinked by an isocyanate. JP-A 58-207054 discloses a carrier having a cover layer including a silicone resin including silicon carbide as a filler. JP-A 61-110161 discloses a positively chargeable carrier having a cover layer including a material having a critical surface energy of not higher than 20 dyne/cm. JP-A 62-273576 discloses a developer including a carrier coated with a material including a fluorinated alkyl(meth)acrylate copolymer and a toner including a chromium-containing azo dye as a charge controlling agent.

Recently, there is an increasing need for high quality images in electrophotography, and therefore the particle diameter of toner used for the electrophotographic developer becomes smaller and smaller. In addition, the image recording speed becomes faster and faster. Therefore, the above-mentioned spent toner problem tends to be easily caused. Further, when toner including a wax is used for developer to enhance the maintenance property thereof, a large amount of spent toner is produced, thereby easily causing a charging problem in that the charge quantity of the toner deteriorates; a toner scattering problem in that toner scatters around a developing device; and a background development problem in that background area of an image is soiled with toner particles.

In order to form a cover layer having good durability on a carrier, it is effective to fixedly adhere a resin having a relatively low surface energy to the surface of a core material. However, resins having a low surface energy generally have poor adhesiveness to core materials. In order to fixedly adhere a resin to core particles, a technique, which is used for TEFLON coating and in which the coated resin is heated at a high temperature or crosslinked, can be preferably used. However, when core materials used for carrier are heated to a temperature higher than the Curie points thereof, the core materials lose their magnetism. Therefore, it is hard to use such a technique for carrier.

When a developer used for electrophotographic full color image forming apparatus causes the spent toner problem and/or a problem in that the cover layer of the coated carrier is abraded or peeled, the resistance of the carrier and the amount of carrier supplied to the development region change, thereby changing the image qualities such as image density (particularly the density of highlighted portions). In addition, when the cover layer is ground and thereby the filler included in the cover layer is mixed with a color toner (particularly yellow toner), the color tone of the color toner is seriously changed, resulting in deterioration of image qualities.

Further, when a carrier is used while the environmental conditions are changed, a problem in that the charge quantity of the carrier changes, resulting in change of image qualities such as image density is often caused.

Because of these reasons, a need exists for a carrier, which can maintain a good chargeability for a long period of time and which can stably produce high quality images with hardly causing the above-mentioned problems such as the spent toner problem, background development problem and toner scattering problem even when the environmental conditions change.

SUMMARY OF THE INVENTION

As an aspect of the present invention, a carrier is provided. The carrier includes a particulate core material having magnetism, and a resin layer located on a surface of the particulate core material. The resin layer is prepared by forming a layer including a copolymer having the below-mentioned formula (1) on the surface of the particulate core material and then subjecting the layer to a heat treatment to crosslink the layer.

formula (1)

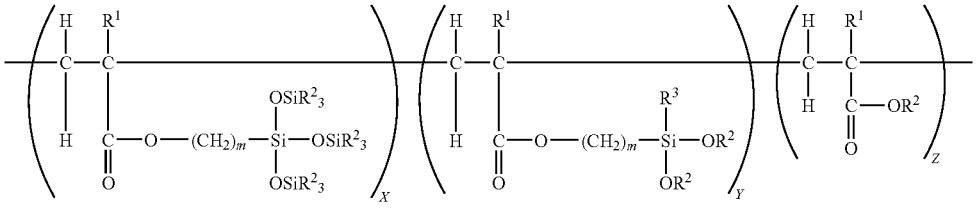

wherein $R^1$ represents a hydrogen atom or a methyl group; m is an integer of from 1 to 8 (i.e., $(CH_2)_m$ represents an alkylene group having 1 to 8 carbon atoms); $R^2$ represents an alkyl group having 1 to 4 carbon atoms; $R^3$ represents an alkyl group having 1 to 8 carbon atoms or an alkoxyl group having 1 to 4 carbon atoms; X represents the content of the first unit (hereinafter referred to as unit A) and ranges from 10 to 40% by mole; Y represents the content of the second unit (hereinafter referred to as unit 3) and ranges from 10 to 40% by mole; and Z represents the content of the third unit (hereinafter referred to as unit C) and ranges from 30 to 80% by mole, wherein a relationship, 60% by mole<Y+Z<90% by mole, is satisfied. The layer is subjected to a heat treatment so that unit B causes a condensation polymerization, resulting in crosslinking of the layer.

As another aspect of the present invention, a developer for developing an electrostatic latent image is provided, which includes the above-mentioned carrier and a toner including at least a binder resin and a colorant.

As yet another aspect of the present invention, an image forming method is provided, which includes forming an electrostatic latent image; and developing the electrostatic latent image with the developer mentioned above to visualize the electrostatic latent image.

It is preferable that the image forming method further includes supplying a supplementary developer to the developing device containing the developer while discharging an excess of the developer from the developing device, wherein the supplementary developer includes the toner and the carrier in a weight ratio (C/T) of the carrier (C) to the toner (T) of from 1/2 to 1/50.

As a further aspect of the present invention, an image forming apparatus is provided. The image forming apparatus includes:

an image bearing member;

an electrostatic image forming device configured to form an electrostatic image on the image bearing member; and a developing device configured to develop the electrostatic latent image with the above-mentioned developer to prepare a toner image on the image bearing member, wherein the developing device includes a developer containing portion containing the developer therein, and a developing sleeve configured to bear a layer of the developer and to develop the electrostatic latent image with the developer layer while forming a gap between the surface of the developing sleeve and the surface of the image bearing member.

As a still further aspect of the present invention, a process cartridge is provided. The process cartridge includes at least the image bearing member and the above-mentioned developing device. The process cartridge is detachably attachable to an image forming apparatus.

As a still further aspect of the present invention, a method for preparing a carrier is provided. The method includes:

forming a layer including the above-mentioned copolymer on a surface of a particulate core material having magnetism; and then subjecting the layer to a heat treatment so that the copolymer causes a dehydration condensation reaction, resulting in crosslinking of the layer.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
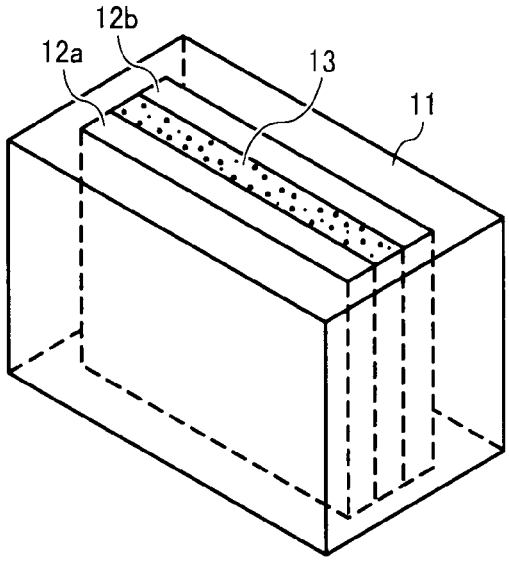
FIG. 1 is a schematic perspective view illustrating a cell used for measuring the resistivity of a carrier.

The present inventors discover that a carrier covered with a resin layer, which is prepared by forming a layer including a copolymer including a unit A having a specific acrylic siloxane structure having a repellency group, a unit B having a specific acrylic silicone structure having a crosslinking ability, and a unit C having a specific acrylic structure in a specific molar ratio and then subjecting the layer to a heat treatment to crosslink the layer, has much better properties than carriers covered with another resin. The present invention is made on the basis of this discovery.

Next, the present invention will be explained in detail.

The carrier of the present invention for use in developer for developing an electrostatic latent image includes a particulate core material having magnetism and a resin layer located on a surface of the core material. The resin layer is prepared by forming a layer including a copolymer having the below-mentioned formula (1) on the surface of the core material, and then subjecting the layer to a heat treatment to crosslink the layer.

Specifically, the carrier of the present invention includes a particulate core material having magnetism, and a resin layer located on a surface of the particulate core material. After a surface of the core material is covered with a layer including a copolymer having the below-mentioned formula (1), the layer is subjected to a heat treatment to prepare the resin layer, which is crosslinked.

formula (1)

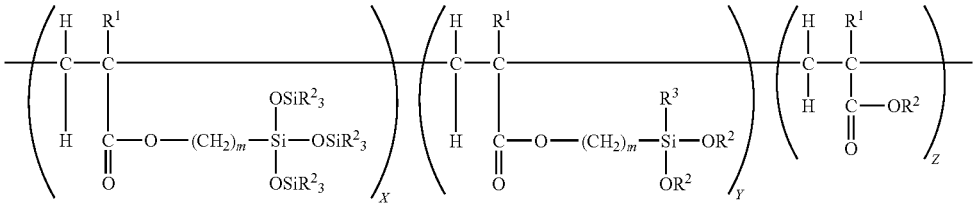

In formula (1), $R^1$ represents a hydrogen atom, or a methyl group; $(CH_2)_m$ represents an alkylene group having 1 to 8 carbon atoms such as methylene, ethylene, propylene and butylene groups; $R^2$ represents an alkyl group (an aliphatic hydrocarbon group) having 1 to 4 carbon atoms such as methyl, ethyl, propyl, isopropyl and butyl groups; and $R^3$ represents an alkyl group having 1 to 8 carbon atoms such as methyl, ethyl, propyl, isopropyl and butyl groups, or an alkoxyl group having 1 to 4 carbon atoms such as methoxy, ethoxy, propoxy and butoxy groups.

The copolymer has a unit A (the left unit in formula (1)) obtained from a monomer A, a unit B (the center unit in formula (I)) obtained from a monomer B, and a unit C (the right unit in formula (1)) obtained from a monomer C.

At first, the unit A, and the monomer for forming the unit A will be explained.

Unit A

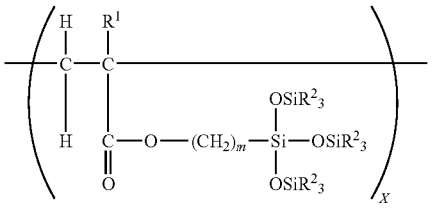

In this formula, $R^1$ represents a hydrogen atom, or a methyl group; $(CH_2)$ m represents an alkylene group having 1 to 8 carbon atoms such as methylene, ethylene, propylene and butylene groups; and $R^2$ represents an alkyl group (an aliphatic hydrocarbon group) having 1 to 4 carbon atoms such as methyl, ethyl, propyl, isopropyl and butyl groups.

In the unit A, X represents the molar ratio of the unit A, and is from 10 to 40% by mole and preferably from 15 to 30% by mole. The unit A has an atom group (tris(trimethylsiloxy) silane) including plural methyl groups in the side chains thereof. When the molar ratio X of the unit A increases, the surface energy of the copolymer decreases, and thereby the resin component and wax component of the toner are hardly adhered to the carrier. When the molar ratio X is too low, the effect can be hardly produced. In contrast, when the molar ratio X is too high, the ratios Y and Z decrease, and thereby the copolymer cannot be well crosslinked in the heat treatment, resulting in occurrence of problems in that the resin layer has poor toughness; adhesiveness of the resin layer to the core material deteriorates; and the durability of the resin layer deteriorates.

Specific examples of monomers capable of forming the unit A include tris(trialkylsiloxy)silane compounds having the following formulae.

$CH_2{=}CMe\text{-}COO{-}C_3H_6{-}Si(OSiMe_3)_3$ $CH_2{=}CH{-}COO{-}C_3H_6{-}Si(OSiMe_3)_3$ $CH_2{=}CMe\text{-}COO{-}C_4H_8{-}Si(OSiMe_3)_3$ $CH_2{=}CMe\text{-}COO{-}C_3H_8{-}Si(OSiEt_3)_3$ $CH_2{=}CH{-}COO{-}C_3H_6{-}Si(OSiEt_3)_3$ $CH_2{=}CMe\text{-}COO{-}C_4H_8{-}Si(OSiEt_3)_3$ $CH_2{=}CMe\text{-}COO{-}C_3H_8{-}Si(OSiPr_3)_3$ $CH_2{=}CH{-}COO{-}C_3H_8{-}Si(OSiPr_3)_3$ $CH_2{=}CMe\text{-}COO{-}C_4H_8{-}Si(OSiPr_3)_3$ In the formulae, Me represents a methyl group, Et represents an ethyl group, and Pr represents a propyl group.

The method for preparing the monomer A for use in forming the unit A is not particularly limited. For example, a method in which a tris(trialkylsiloxane)silane is reacted with allyl acrylate or allyl methacrylate in the presence of a platinum catalyst; a method disclosed in JP-A 11-217389 in which a methacryloyloxyalkyltrialkoxysilane is reacted with a hexaalkyldisiloxane in the presence of a carboxylic acid and an acid catalyst; etc. can be used.

Next, the unit B, and the monomer B (or precursor monomer B) will be explained.

The unit B has the following formula:

Unit B

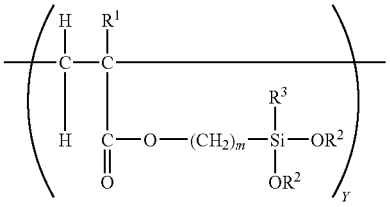

In this formula, $R^1$ represents a hydrogen atom, or a methyl group; $(CH_2)$ m represents an alkylene group having 1 to 8 carbon atoms such as methylene, ethylene, propylene and butylene groups; $R^2$ represents an alkyl group (an aliphatic hydrocarbon group) having 1 to 4 carbon atoms such as methyl, ethyl, propyl, isopropyl and butyl groups; and $R^3$ represents an alkyl group having 1 to 8 carbon atoms such as methyl, ethyl, propyl, isopropyl and butyl groups, or an alkoxyl group having 1 to 4 carbon atoms such as methoxy, ethoxy, propoxy and butoxy groups.

Namely, the monomer B (including precursor monomer) for use in forming the unit B is a radically polymerizable difunctional ($R^3$: alkyl group) or trifunctional ($R^3$: alkoxyl group) silane compound. In the unit B, Y represents the molar ratio of the unit B, and is from 10 to 40% by mole and preferably from 10 to 35% by mole.

The crosslinking reaction is performed as follows. Specifically, when the group —Si—OR group is reacted with water, a silanol group, —Si—OH, is formed. In addition, a silanol group of a polymer chain is reacted with a silanol group of another polymer chain, resulting in formation of a siloxane bond (—Si—O—Si—). Thus, the copolymer is crosslinked.

When the molar ratio Y is too low, the resultant resin layer cannot have good toughness. In contrast, when the molar ratio Y is too high, the resultant resin layer becomes hard and brittle, and thereby the resin layer is easily abraded. In addition, the resultant resin layer cannot exhibit high stability to withstand environmental conditions. The reason therefor is considered to be that a number of silanol groups remain even after the crosslinking component is hydrolyzed, and thereby environmental stability thereof is deteriorated (i.e., the properties of the resin layer greatly change depending on humidity).

Specific examples of the monomer B include
3-methacryloxypropyltrimethoxysilane,
3-acryloxypropyltrimethoxysilane,
3-methacryloxypropyltriethoxysilane,
3-acryloxypropyltriethoxysilane,
3-methacryloxypropylmethyldimethoxysilane,
3-methacryloxypropylmethyldiethoxysilane,
3-methacryloxypropyltri(isopropoxy)silane,
3-acryloxypropyltri(isopropoxy)silane, etc.

A technique for imparting good durability to a film by crosslinking the film is disclosed in a Japanese patent No. 3691115 (JP-A 08-305090). It is disclosed in the Japanese patent that the surface of a particulate magnetic material is covered with a thermally crosslinked resin, which is prepared by crosslinking a copolymer obtained from an organopolysiloxane having a vinyl group at the end thereof and a radically polymerizable monomer having at least one functional group selected from the group consisting of hydroxyl group, amino group, amide group and imide group using an isocyanate compound, to prepare a carrier for use in electrophotographic developers. However, as a result of the present inventors' investigation, the resin layer does not have good durability, so that the peeling/abrasion problem in that the cover layer of the coated carrier is peeled or abraded is caused.

The reason why such a resin layer does not have good durability is not yet determined, but is considered as follows. When such a copolymer as mentioned above is crosslinked by using an isocyanate compound, the number of functional groups capable of reacting with the isocyanate compound (such as amino group, hydroxyl group, carboxyl group, and mercapto group, which have an active hydrogen atom) per a unit weight of the copolymer is small, and thereby a film having a dense two or three dimensional network cannot be formed. Therefore, the resultant carrier easily causes the peeling/abrasion problem, i.e., the carrier has poor durability.

When the peeling/abrasion problem is caused, the electric resistance of the carrier deteriorates, and thereby qualities of images produced by a developer using the carrier are deteriorated. In addition, a carrier adhesion problem in that particles of the carrier adhere to electrostatic latent images is caused. Further, when the peeling/abrasion problem is caused, the fluidity of the resultant developer deteriorates, thereby causing a problem in that the developer cannot be well drawn to a developing sleeve, resulting in decrease of image density. In addition, in this case the toner concentration in the developer increases, and thereby the background development problem and/or the toner scattering problem are caused.

In contrast, in the present invention, the number of crosslinkable di- or tri-functional groups included in a unit weight of the resin having formula (1) is twice or three times that in the copolymer used for the carrier disclosed in the Japanese patent No. 3691115. In addition, since the resin is further subjected to a condensation polymerization to be crosslinked, the resultant film has good toughness, i.e., the film is hardly abraded, resulting in improvement of the durability of the carrier.

Further, the crosslinked structure of the resin used for the resin layer of the carrier of the present invention has higher bond energy than the crosslinked structure of the resin, which is used for the carrier of the Japanese patent No. 3691115 and which is prepared by using an isocyanate compound. Therefore, the resin layer of the carrier of the present invention has good stability even when suffering thermal stresses. Namely, the resin layer is stable over a long period of time.

Next, the unit C, and the monomer C will be explained.

The unit C has the following formula:

Unit C

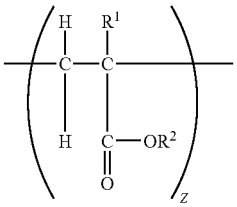

In this formula, $R^1$ represents a hydrogen atom, or a methyl group; $(CH_2)$ m represents an alkylene group having 1 to 8 carbon atoms such as methylene, ethylene, propylene and butylene groups; and $R^2$ represents an alkyl group (an aliphatic hydrocarbon group) having 1 to 4 carbon atoms such as methyl, ethyl, propyl, isopropyl and butyl groups.

Namely, the monomer C (including precursor monomer) for forming the unit C is a radically polymerizable acrylic compound having an acryloyl group or a methacryloyl group. In the unit C, Z represents the molar ratio of the unit C, and is from 30 to 80% by mole and preferably from 35 to 75% by mole. In addition, the sum of Y and Z is greater than 60% by mole and less than 90% by mole, and is preferably greater than 70% by mole and less than 85% by mole. In this regard, X+Y+Z=100% by mole.

The unit C imparts flexibility to the resin layer while improving adhesiveness of the resin layer to the core material.

When the molar ratio Z is too low, the resultant resin layer cannot have good adhesiveness to the core material. In contrast, when the molar ratio Z is too high, the effects of the units A and B cannot be well produced. Namely, a good combination of water repellency, hardness and flexibility (resistance to abrasion) cannot be imparted to the resin layer.

Acrylates and methacrylates are preferably used as the monomer C. Specific examples of the monomer C include methyl methacrylate, methyl acrylate, ethyl methacrylate, ethyl acrylate, butyl methacrylate, butyl acrylate, 2-(dimethylamino)ethyl methacrylate, 2-(dimethylamino)ethyl acrylate, 3-(dimethylamino)propyl methacrylate, 3-(dimethylamino) propyl acrylate, 2-(diethylamino)ethyl methacrylate, 2-(diethylamino)ethyl acrylate, etc. Among these compounds, alkyl methacrylates are preferable, and methyl methacrylate is more preferable. These compounds can be used alone or in combination.

An acrylic copolymer obtained by radically copolymerizing the monomers A, B and C is used for the resin layer. After a layer including the copolymer is formed on the surface of the core material, the layer is subjected to a heat treatment so that the crosslinkable unit B is subjected to a condensation polymerization, resulting in crosslinking the layer.

In general, resins having a high molecular weight have a high viscosity. When a resin having a high viscosity is applied on a core material having a small particle diameter, problems in that particles of the coated core material aggregate, and an uneven resin layer is formed tend to be caused. Therefore, it is difficult to prepare a coated carrier having good properties.

Accordingly, the copolymer used for the resin layer preferably has a weight average molecular weight of from 5,000 to 100,000, and more preferably from 10,000 to 70,000. When the weight average molecular weight is too low, the resultant resin layer has poor mechanical strength. In contrast, when the weight average molecular weight is too high, the viscosity of the resin layer coating liquid seriously increases, resulting in deterioration of productivity of the carrier.

Specifically, in the present invention, a resin, which has relatively low surface energy and low weight average molecular weight and to which toner components are hardly adhered, is applied on a core material, and then the crosslinkable silane component in the unit B is crosslinked to prepare a resin layer having an extremely large molecular weight on the core material. Thus, a carrier, which hardly causes the peeling/abrasion problem and the spent toner problem, can be provided.

The resin for use in forming the resin layer preferably includes not only the above-mentioned copolymer having formula (I) but also a silicone resin having a silanol group or a functional group capable of forming a silanol group by a hydrolysis reaction (such as alkoxyl groups and anionic groups (such as halogeno groups) bonding with a silicon atom). As mentioned above, after applying the resin to the core material, the resin is subjected to a heat treatment so that the resin layer is crosslinked.

Such a silicone resin can cause condensation polymerization by reacting with the crosslinkable unit B of the above-mentioned resin directly or after the unit B modifies the state thereof so as to have a silanol group. By using such a silicone resin in combination with the above-mentioned resin including the silicone resin unit B, the spent toner problem preventing effect of the carrier can be further enhanced.

Silicone resins having a silanol group or a functional group capable of forming a silanol group by a hydrolysis reaction for use in the resin layer of the carrier of the present invention preferably include at least one of the following groups:

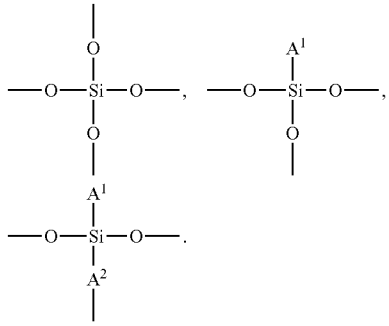

In the above formulae, $A^1$ represents a hydrogen atom, a halogen atom, a hydroxyl group, a methoxy group, an alkyl group having 1 to 4 carbon atoms, or an aryl group (such as phenyl and tolyl groups); and $A^2$ represents an alkylene group having 1 to 4 carbon atoms, or an arylene group (such as phenylene groups). In this regard, the aryl group has 6 to 20 carbon atoms, and preferably from 6 to 14 carbon atoms. The aryl group includes aryl groups derived from benzene (such as phenyl groups), aryl groups derived from condensed aromatic polycyclic hydrocarbons (such as naphthalene, phenanthrene and anthracene), and aryl groups derived from linear aromatic polycyclic hydrocarbons (such as biphenyl and terphenyl). The aryl group may have one or more substituents.

Specific examples of marketed silicone resins for use as the silicone resin include KR251, KR271, KR272, KR282, KR252, KR255, KR152, KR155, KR211, KR216 and KR213 (from Shin-Etsu Chemical Co., Ltd.); AY42-170, SR2510, SR2400, SR2406, SR2410, SR2405 and SR2411 (from Dow Corning Toray Silicone Co., Ltd.); etc.

As mentioned above, various silicone resins can be used as the silicone resin. Among these silicone resins, methyl silicone resins are preferably used because of producing a coated carrier having good spent toner problem preventing effect and good charge stability such that toner is charged by the carrier so as to have a predetermined amount of charge even when the environmental conditions change.

The silicone resin for use in preparing the resin layer has a weight average molecular weight of from 1,000 to 100,000, and preferably from 1,000 to 30,000. When the molecular weight is too high, the viscosity of the resin layer coating liquid seriously increases, and thereby a uniform resin layer cannot be formed and/or the density of the resin layer cannot be sufficiently increased even after the crosslinking reaction. In contrast, when the molecular weight is too low, the resultant resin layer becomes brittle even after the crosslinking reaction. Therefore, the silicone resin preferably has a weight average molecular weight in the above-mentioned range.

The weight ratio (SR/C) of the silicone resin (SR) to the above-mentioned copolymer (C) having formula (1) is generally from 0.05 to 0.8, and preferably from 0.10 to 0.60. When the ratio is too low, the spent toner preventing effect cannot be well produced. In contrast, when the ratio is too high, the toughness of the resin layer deteriorates, and thereby the abrasion problem tends to be caused.

Silane coupling agents can be used for forming the resin layer of the carrier of the present invention to improve the dispersibility of a filler to be included in the resin layer and/or to adjust the amount of charge of the toner used in combination of the carrier. Particularly, when a silicone resin is used for forming the resin layer, the below-mentioned amino silane coupling agents are preferably used in combination therewith to adjust the amount of charge of the toner. In this regard, the added amount of a silane coupling agent is preferably from 0.001 to 30% by weight based on the weight of the silicone resin used for the resin layer.

Specific examples of such amino silane coupling agents include the following:

| | |
|---|---|
| $H_2N(CH_2)_3Si(OCH_3)_3$ | (Mw of 179.3) |
| $H_2N(CH_2)_3Si(OC_2H_5)_3$ | (Mw of 221.4) |
| $H_2NCH_2CH_2CH_2Si(CH_3)_2(OC_2H_5)$ | (Mw of 161.3) |
| $H_2NCH_2CH_2CH_2Si(CH_3)(OC_2H_5)_2$ | (Mw of 191.3) |
| $H_2NCH_2CH_2NHCH_2Si(OCH_3)_3$ | (Mw of 194.3) |
| $H_2NCH_2CH_2NHCH_2CH_2CH_2Si(CH_3)(OCH_3)_2$ | (Mw of 206.4) |
| $H_2NCH_2CH_2NHCH_2CH_2CH_2Si(OCH_3)_3$ | (Mw of 224.4) |
| $(CH_3)_2NCH_2CH_2CH_2Si(CH_3)(OC_2H_5)_2$ | (Mw of 219.4) |
| $(C_4H_9)_2NC_3H_6Si(OCH_3)_3$ | (Mw of 291.6) |

In order to accelerate the condensation reaction in forming the resin layer of the carrier of the present invention, condensation reaction accelerating catalysts, which subject two or more alkoxysilyl groups, two or more alkenyloxylyl groups or combinations of an alkoxysilyl group and a silanol group to condensation reaction to crosslink the resin layer, are preferably used.

Suitable materials for use as the condensation reaction accelerating catalyst include organic tin compounds, organic titanate compounds, organic zirconium compounds, and organic aluminum compounds.

Specific examples of the condensation reaction accelerating catalyst include organic tin compounds such as dibutyltin dilaurate, dibutyltin dimaleate, dioctyltin dilaurate, dioctyltin dimaleate, and tin octylate; organic titanate compounds such as isopropyltriisostearoyl titanate, isopropyltris(dioctylpyrophosphate) titanate, bis(dioctylpyrophosphate)oxyacetate titanate, titanium diisopropoxybis(ethylacetoacetate), titanium tetra-n-butoxide, titanium diisopropoxybis(triethanolaminate), and tetraalkyl titanate; organic zirconium compounds such as tetrabutyl zirconate, tetrakis(acetylacetonato) zirconium, tetraisobutyl zirconate, zirconium tetraacetylacetonate, and butoxytris(acetylacetonato) zirconium; and organic aluminum compounds such as tris(ethylacetoacetate) aluminum and tris(acetylacetonato)aluminum.

The added amount of such a condensation reaction accelerating catalyst is from 0.1 to 10 parts by weight based on 100 parts by weight of the resin used for forming the resin layer.

As mentioned above, after a resin layer is formed on the surface of the core material, the resin layer is subjected to a heat treatment. In this regard, the heat treatment is preferably performed at a temperature lower than the Curie point of the core material, preferably from 130 to 300° C., and more preferably from 150 to 250° C., to accelerate the crosslinking reaction (i.e., condensation reaction). When the treatment temperature is too low, the crosslinking reaction cannot be well performed, and thereby the resultant resin layer has insufficient mechanical strength. In contrast, when the treatment temperature is too high, the abrasion problem tends to be caused because the resin having formula (1) tends to carbonize.

The carrier of the present invention includes a particulate magnetic core material and a resin layer located on a surface of the core material, and has a weight average particle diameter Dw of from 22 μm to 90 μm, preferably from 22 μm to 45 μm, and more preferably from 22 μm to 35 μm. When the weight average particle diameter Dw is too large, a problem in that latent images cannot be faithfully developed with the toner used in combination with the carrier, i.e., the particle diameter of dot images greatly varies, resulting in formation of grainy images (i.e., formation of uneven density images) is caused. In addition, when the toner concentration is relatively high, the background development problem is easily caused.

Depending on the electric fields formed in the image portions and background portions of latent images, the carrier adhesion problem in that carrier particles are adhered to the image portions and/or the background portions is caused. In this regard, as the electric field increases, the carrier adhesion problem is caused more frequently. Since the image portions are developed with toner and thereby the electric field is decreased in the image portions, the carrier adhesion problem is caused in the image portions less frequently than in the background portions.

In the present application, the weight average particle diameter Dw of carrier, magnetic core material, and toner is calculated from a particle diameter distribution curve on the number basis showing the relationship between particle diameter and frequency (number of particles having the particle diameter). Namely, the weight average particle diameter Dw is represented by the following equation:

$$Dw=\{1/\Sigma(nD^3)\}\times\{\Sigma(nD^4)\}$$

In this equation, D represents the representative particle diameter (in units of μm) representing each particle diameter channel, and n is the total number of particles included in each particle diameter channel.

In this regard, the channels mean particle diameter ranges into which particles of a particulate material are classified with respect to particle diameter. In the particle diameter measuring method used in this application, the width of each channel is 2 μm. In addition, the minimum particle diameter of each channel is used as the representative particle diameter D of the channel.

In this application, a MICROTRACK PARTICLE ANALYZER Model FRA9320-X100 from Honeywell, Inc. is used for measuring the particle diameter distribution of carrier and magnetic core material. The measuring conditions are as follows:

(1) Particle diameter range: 8 μm to 100 μm
(2) Width of channel: 2 μm
(3) Total number of channels: 46
(4) Refractive index: 2.42

Known magnetic materials can be used for the particulate core material of the carrier of the present invention. The magnetic moment of the core material is preferably not less than 40 emu/g and more preferably not less than 50 emu/g at a magnetic field of 1000 oersted (Oe). The upper limit of the magnetic moment of the core material is not particularly limited, but is generally about 150 emu/g. When the magnetic moment of the core material is too low, the carrier adhesion problem tends to be caused.

In the present application, the magnetic moment is measured by the following method.

A B-H tracer (BHU-60 from Riken Denshi Co., Ltd.) is used for measuring the magnetic moment. At first, 1.0 gram of a core material is contained in a cylindrical cell and the cell is set in the B-H tracer. A magnetic field is applied to the core material while gradually increased from 0 to 3,000 Oe. Next, the magnetic field is gradually decreased from 3,000 to 0 Oe. In addition, an opposite magnetic field is applied to the core material while gradually increased from 0 to 3,000 Oe, followed by decreasing the reverse magnetic field from 3,000 to 0 Oe. Further, the first-mentioned magnetic field is applied again to the core material while gradually increased from 0 to 3,000 Oe to obtain a B-H curve of the core material. The magnetic moment of the core material at a magnetic field of 1,000 Oe is determined from the B-H curve.

Specific examples of the materials for use as the core material of the carrier of the present invention, which have a magnetic moment of not less than 40 emu/g at a magnetic field of 1,000 Oe, include ferromagnetic materials such as iron and cobalt; magnetite; hematite; ferrites such as Li ferrite, Mn—Zn ferrite, Cu—Zn ferrite, Ni—Zn ferrite, Ba ferrite, and Mn ferrite; etc.

Ferrites mean sintered materials having the following formula.

$$(MO)_X(NO)_Y(Fe_2O_3)_Z$$

wherein X+Y+Z=100% by mole; and M and N independently represent a metal atom such as Ni, Cu, Zn, Li, Mg, Mn, Sr and Ca.

Namely, ferrites are perfect mixtures of a metal (II) oxide and ferric (III) oxide.

Specific examples of the materials for use as the core material of the carrier of the present invention, which have a magnetic moment of not less than 50 emu/g at a magnetic field of 1,000 Oe, include iron, magnetite, Mn—Mg ferrite, Mn—Mg—Sr ferrite, Mn ferrite, etc.

Magnetic powder-dispersed resin carriers having configuration such that a magnetic powder is dispersed in a resin (such as phenolic resins, acrylic resins and polyester resins) can also be used for the particulate core material of the carrier of the present invention.

In order to enhance the mechanical strength of the resin layer of the carrier and to adjust the resistance of the resin layer, a filler can be included in the resin layer. The content of a filler in the resin layer is preferably from 2 to 500% by weight, and more preferably from 5 to 400% by weight based on the weight of the resin included in the resin layer. The content is determined depending on the particle diameter and specific surface area of the filler used. When the content is too low, the abrasion resistance of the resin layer is hardly improved. In contrast, when the content is too high, the filler is easily released from the resin layer.

Specific examples of the filler include powders of electroconductive ZnO; metals such as aluminum; metal oxides such as silica, alumina, titanium oxide, $SnO_2$ which is prepared by any known methods, and $SnO_2$ doped with an element; boron compounds such as $TiB_2$, $ZnB_2$ and $MoB_2$; silicon carbide; electroconductive polymers such as polyacetylene, polyparaphenylene, poly(para-phenylenesulfide), polypyrrole, and polyaniline; carbon blacks such as furnace black, acetylene black, and channel black; etc.

The method for preparing a filler-dispersed resin layer coating liquid is as follows. A filler, a resin solution and an optional solvent are mixed, and the mixture is subjected to a dispersing treatment using a dispersing device such as media dispersing devices (e.g., ball mills and bead mills), and agitators having a blade rotating at a high speed, to prepare a filler-dispersed resin layer coating liquid. In this regard, the filler-dispersed resin layer coating liquid can include a dispersing agent and/or a silane coupling agent in a proper amount.

Specific examples of the method for forming the resin layer on a core material include spray dry methods and dipping methods. In addition, powder coating methods can also be used. Particularly, methods using a fluidized bed type coating device can be preferably used because an even resin layer can be formed thereby.

The thickness of the resin layer formed on the surface of a core material is generally from 0.02 μm to 3.0 μm, and preferably from 0.03 μm to 1.0 μm.

In the present application, the thickness (average thickness) of a resin layer formed on a core material is determined by observing the cross section of the resin layer using a transmission electron microscope (TEM).

The resistivity of the carrier of the present invention in a logarithmic scale, i.e., (log (RΩ·cm)), is preferably from 9.0 to 16.0, and more preferably from 10.0 to 15.0 when measured by applying a voltage of 1,000V/2 mm thereto. By controlling the resistivity of the carrier, high definition images having good combination of fine line reproducibility and color reproducibility can be produced without causing an edge effect problem in that the edge portions of a solid image have higher image density than the other portion thereof.

When log (R) is too low, the carrier adhesion problem is frequently caused. In contrast, when log (R) is too high, an image problem in that rear end portions of images have white spots is caused.

The reason why the carrier adhesion problem is easily caused when log (R) of the carrier is too low is considered as follows. Specifically, when log (R) is too low, charges are induced in the carrier particularly when the development gap (i.e., minimum distance between the surface of the photoreceptor and the surface of the developing sleeve (developing roller)) is narrow, and thereby the carrier adhesion problem is easily caused. In this regard, a serious carrier adhesion problem is caused when the linear speed of the photoreceptor and/or the developing sleeve increases, and/or an AC bias is applied as a developing bias. In general, carriers having relatively low resistivity are used for developers for use in forming color toner images so that the resultant color toner image has relatively heavy weight compared to the same black image. By using a carrier having resistivity in the above-mentioned range in combination with a toner having proper charge quantity, high density images can be produced.

When a carrier having resistivity greater than the above-mentioned range, charges with a polarity opposite to that of the toner used in combination with the carrier tend to be stored in the carrier, and thereby the carrier adhesion problem is easily caused.

In the present application, the resistivity of a carrier is measured by the following method.

FIG. 1 illustrates a cell used for measuring resistivity of carrier. A carrier 13 is contained in a cell 11, which is made of a fluorine-containing resin and which has electrodes 12*a* and 12*b*, wherein each of the electrodes 12*a* and 12*b* has a dimension of 2 cm×4 cm and the distance between the electrodes 12*a* and 12*b* is 2 mm. A DC voltage of 1,000V is applied between the electrodes 12*a* and 12*b*, and the resistance (Ω) of the carrier is measured with an instrument, HIGH RESISTANCE METER 4329A (4329A+LJK 5HVLVWDQFH OHWHU from Hewlett-Packard Japan, Ltd.). Next, the volume resistivity R (Ω·cm) of the carrier is calculated from the thus measured resistance.

A carrier is fed into the cell until the carrier overflows from the cell without applying a pressure to the carrier. After the cell is tapped 20 times, a nonmagnetic flat blade is slid once along the upper surface of the cell to remove the portion of the carrier projected from the cell.

The resistivity (RΩ·cm) of the carrier can be adjusted by adjusting the resistance and thickness of the resin layer formed on the core material. The resistance of the resin layer can be adjusted by using a resin having different resistivity and/or including an electroconductive filler therein.

The developer of the present invention includes a toner and the above-mentioned carrier of the present invention.

The toner for use in the developer of the present invention is that toner components such as colorants, particulate materials, charge controlling agents, and release agents are included in a binder resin. The toner includes at least a binder resin and a colorant. The method for manufacturing the toner for use in the developer of the present invention is not particularly limited, and any known methods such as melt-kneading/pulverization methods, polymerization methods, granulation methods can be used. In addition, the particle form of the toner is not particularly limited, and any known toners such as toners with irregular form or spherical toners can also be used. Further, both of magnetic toners and non-magnetic toners can be used.

Specific examples of the resins for use as the binder resin of the toner include homopolymers of styrene and substituted styrene such as polystyrene and polyvinyl toluene; styrene copolymers such as styrene-p-chlorostyrene copolymers, styrene-propylene copolymers, styrene-vinyl toluene copolymers, styrene-methyl acrylate copolymers, styrene-ethyl acrylate copolymers, styrene-butyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, styrene-maleic acid copolymers and styrene-maleic acid ester copolymers; acrylic resins such as polymethylmethacrylate, and polybutyl methacrylate; and other resins such as polyvinyl chloride, polyvinyl acetate, polyethylene, polypropylene, polyesters, polyurethane resins, epoxy resins, polyvinyl butyral resins, polyacrylic acid resins, rosin, modified rosins, terpene resins, phenolic resins, aliphatic or alicyclic hydrocarbon resins, aromatic petroleum resins, chlorinated paraffin, paraffin waxes, etc. These resins are used alone or in combination.

By using a polyester resin as a binder resin, the resultant toner has relatively good preservation stability and low melt viscosity compared to those of toners including a styrene resin or an acrylic resin as a binder resin.

Such polyester resins can be prepared by subjecting an alcohol and an acid to a polycondensation reaction.

Suitable alcohol components for use in preparing such polyester resins include diols and polyols. Specific examples of diols include diols such as polyethylene glycol, diethylene glycol, triethylene glycol, 1,2-propylene glycol, 1,3-propylene glycol, 1,4-butanediol, neopentyl glycol, 1,4-butenediol, 1,5-pentanediol and 1,6-hexanediol; bisphenols and derivatives thereof such as 1,4-bis(hydroxymethyl)cyclohexane, bisphenol A, hydrogenated bisphenol A, etherified bisphenol A such as polyoxyethylenated bisphenol A and polyoxypropylenated bisphenol A, etc. Those diols can be substituted with a saturated or unsaturated hydrocarbon group having from 3 to 22 carbon atoms.

Specific examples of the polyhydric alcohols having three or more hydroxyl groups for use in preparing such polyester resins include sorbitol, 1,2,3,6-hexanetetrol, 1,4-sorbitane, pentaerythritol, dipentaerythritol, tripentaerythritol, sucrose, 1,2,4-butanetriol, 1,2,5-pentanetriol, glycerol, 2-methylpropanetriol, 2-metyl-1,2,4-butanetriol, trimethylol ethane, trimethylol propane, 1,3,5-trihydroxymethyl benzene, etc.

Suitable acid components include monocarboxylic acids, dibasic carboxylic acids, and polybasic carboxylic acids having three or more carboxyl groups.

Specific examples of the monocarboxylic acids include palmitic acid, stearic acid, oleic acid, etc. Specific examples of the dibasic carboxylic acids include dibasic organic acids such as maleic acid, fumaric acid, mesaconic acid, citraconic acid, terephthalic acid, cyclohexane dicarboxylic acid, succinic acid, adipic acid, sebacic acid, malonic acid, etc.; substituted dibasic organic acids in which the above-mentioned dibasic organic acids are substituted with a saturated or unsaturated hydrocarbon group having from 3 to 22 carbon atoms; anhydrides and lower alkyl esters of the above-mentioned dibasic organic acids; dimmer acids of linolenic acid; etc.

Specific examples of the polybasic carboxylic acids include 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-carboxymethyl propane, tetra(methylenecarboxyl) methane, 1,2,7,8-octane tetracarboxylic acid, anhydrides of these acids, etc.

Specific examples of the epoxy resins for use as the binder resin include polycondensation products of bisphenol A and epichlorohydrin, etc. Specific examples of the marketed epoxy resins include EPOMIC R362, R364, R365, R366, R367, and R369 (which are manufactured by Mitsui Petrochemical Industries, Ltd.), EPOTOHTO YD-011, YD-012, YD-014, YD-904, and YD-017 (which are manufactured by Tohto Kasei Co., Ltd.), EPOCOAT 1002, 1004 and 1007 (which are manufactured by Shell Chemical), etc.

Specific examples of the colorant includes known dyes and pigments such as carbon blacks, lamp blacks, iron blacks, ultramarine blue, Nigrosine dyes, Aniline Blue, Phthalocyanine Blue, Phthalocyanine Green, HANSA YELLOW G, Rhodamine 6C Lake, chalco-oil blue, Chrome Yellow, quinacridone, BENZIDINE YELLOW, Rose Bengale, triarylmethane dyes, monoazo pigments, disazo pigments, etc. These colorants can be used alone or in combination.

A magnetic material can be included in the toner to prepare a magnetic toner. Specific examples of the magnetic materials include ferromagnetic materials such as iron and cobalt, magnetite, hematite, ferrites such as Li ferrite, Mn—Zn ferrite, Cu—Zn ferrite, Ni—Zn ferrite, Ba ferrite, etc.

A charge controlling agent can be included in the toner for use in the developer of the present invention to control the friction-charging properties of the toner. Specific examples of the charge controlling agents include metal complexes of monoazo dyes, nitrohumic acid and its salts, metal (such as Co, Cr and Fe) complexes of salicylic acid, naphthoic acid and dicarboxylic acid, amino compounds, quaternary ammonium compounds, organic dyes, etc.

A release agent can be included in the toner for use in the developer of the present invention. Specific examples of the release agents include low molecular weight polyethylene, low molecular weight polypropylene, carnauba waxes, microcrystalline waxes, jojoba waxes, rice waxes, montan waxes, etc. These release agents can be used alone or in combination. The release agent is not limited thereto.

An external additive can be added to the toner to improve the fluidity, releasability and/or other properties of the toner. Suitable fluidity improving agents include hydrophobized metal oxides and particulate lubricants. Suitable fluidity improving agents include metal oxides, particulate resins, and metal soaps. Specific examples of such additives include lubricants such as fluorine-containing resins (e.g., polytetrafluoro ethylene) and metal soaps such as zinc stearate; abrasives such as cerium oxide and silicon carbide; fluidity improving agents such as hydrophobized silica and titanium oxide; caking preventing agents, etc. These materials can be subjected to a surface treatment. Among the fluidity improving agents, hydrophobized silica is preferably used.

The toner for use in the developer of the present invention has a weight average particle diameter (Dw) of from 3.0 μm to 9.0 μm, and preferably from 3.0 μm to 6.0 μm. The weight ratio (T/C) of the toner (T) to the carrier (C) in the developer of the present invention is from 2/100 to 25/100, and preferably from 3/100 to 20/100. In the present application, the particle diameter of toner is measured with an instrument, MULTISIZER II from Beckman Coulter Inc.

In the developer of the present invention, the toner preferably has a charge quantity of from 10 μC/g to 60 μC/g, and more preferably from 15 μC/g to 50 μC/g. When the charge quantity is too small, the background development problem and toner scattering problem tend to be easily caused. In contrast, when the charge quantity is too large, the carrier adhesion problem tends to be easily caused.

Figure 2:
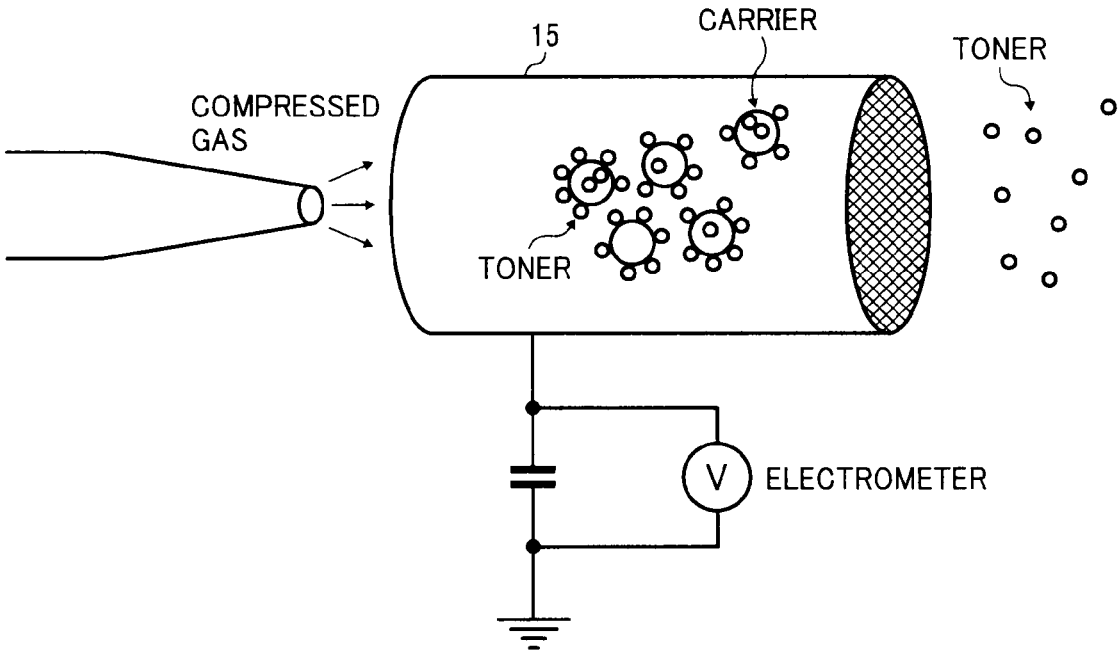
FIG. 2 is a schematic view illustrating a charge quantity measuring system for measuring the charge quantity of a developer including a carrier and a toner.

The method for measuring the charge quantity of a developer will be explained by reference to FIG. 2.

A certain amount of developer is contained in an electroconductive cage 15 having a metal screen on each end thereof. In this regard, the diameter of openings of the metal screen is less than the particle diameter of the carrier and greater than that of the toner, and is 20 μm in this case so that the toner can pass through the screen. A compressed nitrogen gas having a pressure of 1 kgf/cm$^2$ ($9.8\times10^4$ Pa) is applied to the cage for 60 seconds so that the toner is released from the carrier and discharged from the cage. In this case, carrier particles having a charge quantity (Q) with a polarity opposite to that of the toner remain in the cage. As illustrated in FIG. 2, the charge quantity (Q) remaining in the cage is measured with an electrometer. The charge quantity (Q/M) of the toner per unit weight (g) is calculated on the basis of the thus determined charge quantity (Q) and the weight (M) of the toner. As mentioned above, the unit of the charge quantity (Q/M) of the toner is μC/g.

Next, the developing method (image forming method) of the present invention will be explained. The developing method uses the developer mentioned above, which includes the carrier of the present invention and a toner having a weight average particle diameter of from 3.0 μm to 9.0 μm. By using the developing method, high quality images, which particularly have good granularity property (i.e., good evenness), can be produced.

An example of the developing method uses a developing device having a developing sleeve (developing roller), to which a voltage (development bias) is applied, the developer mentioned above, which includes the carrier of the present invention, and a toner having a weight average particle diameter of from 3.0 μm to 9.0 μm, and preferably from 3.0 μm to 6.0 μm. The minimum distance (i.e., development gap) between the surface of the photoreceptor and the surface of the developing sleeve is preferably not greater than 0.4 mm. The development bias preferably includes an AC voltage. By using such a developing method, high quality images can be produced with hardly causing the carrier adhesion problem.

When a DC voltage superimposed with an AC voltage is applied as the development bias, images having high image density can be produced. Particularly, highlighted portions have even image density (i.e., less granularity) can be produced.

In addition, when only a DC voltage is applied as the development bias, the carrier adhesion problem is hardly caused while the edge effect is dramatically improved. In addition, since the developing method has sufficient tolerance for the background development problem, the content of the toner can be increased, and thereby the charge quantity of toner can be increased (i.e., the development bias can be decreased), resulting in formation of high density images.

Next, the developing method (image forming method), developing device and image forming apparatus of the present invention will be explained by reference to certain specific examples which are provided herein for the purpose of illustration only and are not intended to be limiting.

Figure 3:
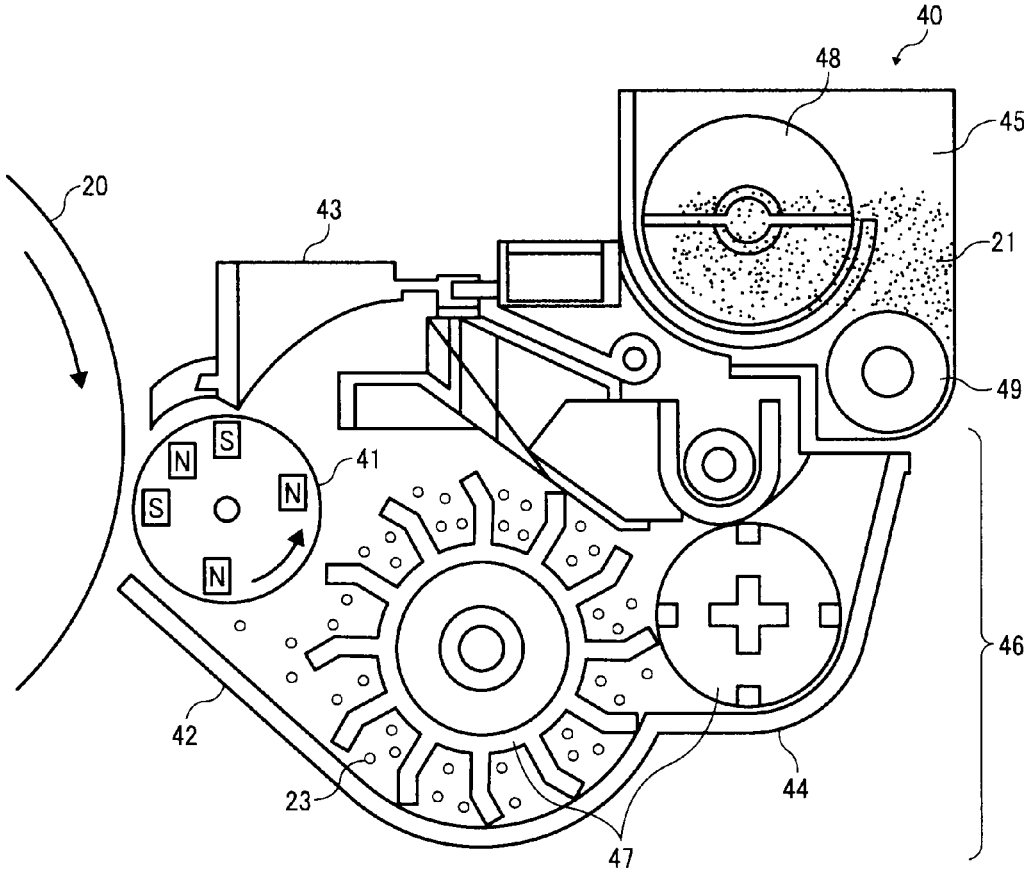
FIG. 3 is a schematic view illustrating a developing device for use in the image forming method and apparatus of the present invention.

FIG. 3 is a schematic view for explaining the developing method and developing device of the present invention. The present invention is not limited thereto, and modifications such as the below-mentioned modifications can be made thereto.

Referring to FIG. 3, a developing device 40 is arranged so as to be opposed to an image bearing member 20 (photoreceptor drum). The developing device 40 includes as main components a developing sleeve 41, a developer containing portion 46 including a developer container 42 and a support case 44, and a doctor blade 43 serving as a regulating member.

A toner hopper 45 serving as a toner container is connected with the support case 44, which has an opening on the photoreceptor side thereof. The developer containing portion 46, which is located in the vicinity of the toner hopper 45, contains the developer of the present invention including a toner 21 and a carrier 23, which is the carrier of the present invention, and has developer agitators 47 configured to agitate the developer to impart frictional/releasing charges to particles of the toner 21.

In the toner hopper 45, a toner agitator 48 and a toner supplying member 49, which are rotated by a driving device (not shown), are provided. The toner agitator 48 and the toner supplying member 49 supply the toner 21 in the toner hopper 45 to the developer containing portion 46 while agitating the toner.

The developer sleeve 41, which is arranged so as to be opposed to the image bearing member 20, is rotated by a driving device (not shown) in a direction indicated by an arrow. The developing sleeve 41 has magnets therein to form magnetic brush (i.e., chains of carrier particles (developer)) thereon. The magnets serve as a magnetic field forming member, and are fixed (i.e., do not move).

The doctor blade 43 serving as a regulating member is integrally provided on one side of the developer container 42. In this example, the doctor blade 43 is arranged with a predetermined gap between the tip of the doctor blade and the circumferential surface of the developing sleeve 41.

When this developing device is used, the developing method is performed as follows. Specifically, the toner 21 fed from the toner hopper 45 to the developer containing portion 46 by the toner agitator 48 and toner supplying member 49, and the toner 21 and carrier 23 (i.e., the developer) are agitated by the developer agitators 47, resulting in impartment of frictional/releasing charge to the toner. The developer is born on the surface of the developing sleeve 41, and then fed to the development region, in which the developing sleeve is opposed to the image bearing member 20. In the developing region, only the toner 21 is adhered to an electrostatic latent image formed on the image bearing member 20, resulting in formation of a toner image on the surface of the image bearing member 20.

Figure 4:
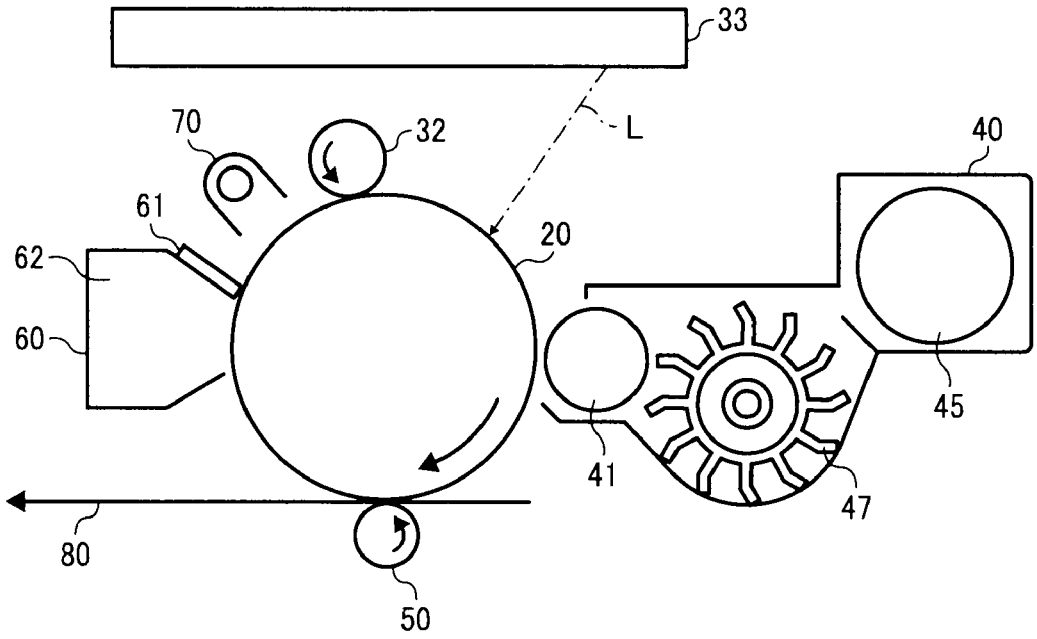
FIG. 4 is a schematic view illustrating an example of the image forming apparatus of the present invention.

FIG. 4 is a cross-sectional view of an example of the image forming apparatus of the present invention, which includes the developing device mentioned above. The image forming apparatus includes a charging device 32 configured to charge a photoreceptor drum serving as the image bearing member 20; a light irradiating device 33 configured to irradiate the charged photoreceptor with light L to form an electrostatic latent image on the photoreceptor drum 20; the developing device 40 configured to develop the electrostatic latent image with the developer of the present invention to form a toner image on the photoreceptor drum; a transfer device 50 configured to transfer the toner image onto a receiving material 80; a cleaning device 60 configured to clean the surface of the photoreceptor drum; and a discharging lamp 70 configured to reduce the residual charges present on the photoreceptor drum. These devices are arranged around the photoreceptor drum 20. In this image forming apparatus, the charging device 32 and the light irradiating device 33 serve as an electrostatic latent image forming device.

In this image forming apparatus, the charging device 32 is a short-range charger, and the gap between the surface of the photoreceptor drum 20 and the surface of the charging roller of the charging device 32 is about 0.2 mm. In this regard, it is preferable to apply a DC voltage superimposed with an AC voltage to the charging device 32 so that the photoreceptor drum 20 can be evenly charged by the charging device.

This example of the image forming apparatus performs a nega-posi image forming operation. Specifically, after charges remaining on the photoreceptor drum serving as the image bearing member 20, which is typified by an organic photoreceptor (OPC) having an organic photosensitive layer, are discharged by the discharging lamp 70, the surface of the photoreceptor drum is negatively charged by the charging device 32 such as charging wires and charging rollers. Next, laser light emitted by the light irradiating device 33 irradiates the charged photoreceptor drum 20 to form an electrostatic latent image thereon. In this regard, the absolute value of the potential of an irradiated portion of the photoreceptor drum 20 is lower than that of a non-irradiated portion thereof.

Laser light emitted by a laser diode of the light irradiating device 33 is reflected by a polygon mirror, which is rotated at a high speed, to scan the surface of the photoreceptor drum 20 in a direction (i.e., main scanning direction) parallel to the rotation axis of the photoreceptor drum, resulting in formation of an electrostatic latent image on the photoreceptor drum. The thus formed electrostatic latent image is developed with the developer of the present invention (i.e., mixture of particles of the toner 21 and carrier 23) on the developing sleeve 41, resulting in formation of a toner image on the photoreceptor drum 20. In the developing process, a proper DC voltage, which may be superimposed with an AC voltage and whose voltage is between the potential of the light-irradiated portion of the photoreceptor drum and the potential of the non-irradiated portion thereof, is applied as a developing bias to the developing sleeve 41 by a voltage applicator (not shown).

On the other hand, the receiving material 80 such as paper sheets is fed by a feeding device (not shown). The thus fed receiving material 80 is timely fed by a pair of registration rollers to a transfer nip between the photoreceptor drum and the transfer device 50 so that the toner image on the photoreceptor drum 20 is transferred onto a proper position of the receiving material 80 in the transfer region. In this regard, it is preferable that a voltage having a polarity opposite to that of charge of the toner 21 is applied as a transfer bias to the transfer device 50. The receiving material 80 bearing the toner image thereon is then separated from the photoreceptor drum 20. Thus, a toner image (transfer image) is formed on the receiving material.

Toner particles remaining on the photoreceptor drum 20 even after the transfer process are removed therefrom by a cleaning blade 61 of the cleaning device 60. The thus collected toner particles are stored in a residual toner collecting portion 62. The collected toner particles may be fed by a toner recycling device (not shown) to the developing device or the toner hopper 45 to be reused.

The receiving material 80 bearing the toner image thereon is then fed to a fixing device (such as heat fixing devices) to fix the toner image on the receiving material.

The image forming apparatus may have two or more developing devices to prepare different color toner images. In this case, color toner images on the photoreceptor drum 20 are sequentially transferred onto proper positions of the receiving material 80 to form a combined color toner image thereon. The receiving material bearing the combined color toner image is then fed to a fixing device to fix the combined toner image. In this case, multiple color images (such as full color images) can be formed.

In addition, an image forming apparatus, in which the toner images formed on the photoreceptor drum 20 are sequentially transferred onto an intermediate transfer medium to form a combined toner image thereon, and the combined toner image is then transferred onto a receiving material, followed by fixing the toner image, can also be used as the image forming apparatus of the present invention.

Figure 5:
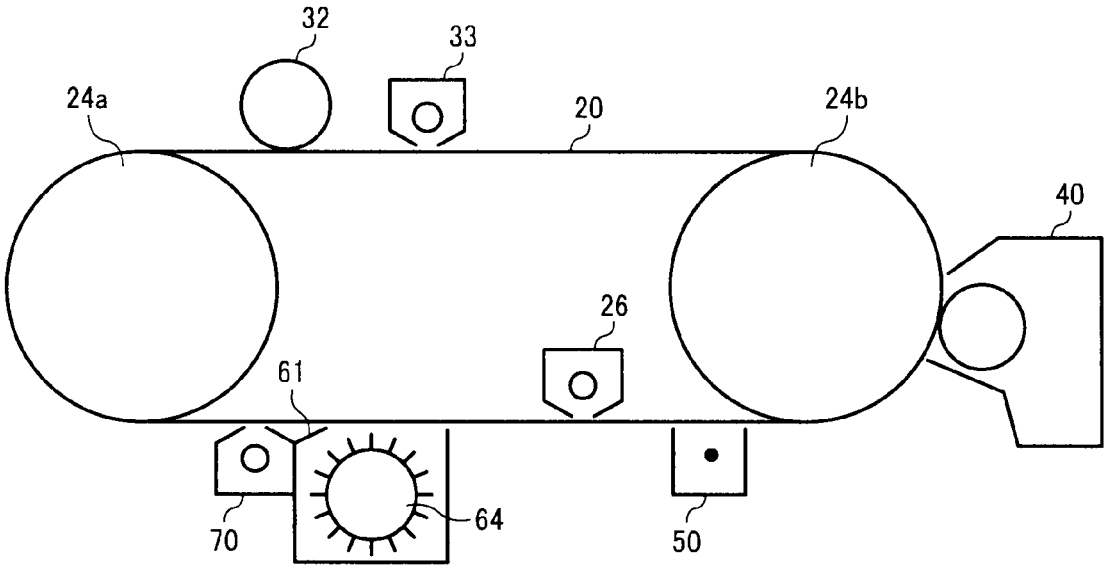
FIG. 5 is a schematic view illustrating another example of the image forming apparatus of the present invention.

FIG. 5 illustrates another example of the image forming apparatus of the present invention. The image bearing member 20 is an endless-belt form photoreceptor having configuration such that at least a photosensitive layer is formed on an electroconductive substrate. The photoreceptor is driven so as to be rotated by driving rollers 24*a* and 24*b*. Similarly to the image forming apparatus illustrated in FIG. 4, the photoreceptor belt 20 is charged by the charging device 32, and then exposed to imagewise light emitted by the light irradiating device 33, resulting in formation of an electrostatic latent image on the photoreceptor. The electrostatic latent image is developed by the developing device 40 to form a toner image on the photoreceptor belt, and the toner image is transferred onto a receiving material (not shown) by a charger 50 serving as the transfer device. The photoreceptor belt 20 is then subjected to a pre-cleaning light irradiating process using a light source 26; a cleaning process using a cleaning device including the cleaning blade 61 and a cleaning brush 64; and a discharging process using the discharging lamp 70. In the image forming apparatus illustrated in FIG. 5, the pre-cleaning light irradiation process is performed from the backside (substrate side) of the photoreceptor belt 20. In this regard, the substrate of the photoreceptor belt 20 is transparent so that light used for the pre-cleaning light irradiation process reaches the photosensitive layer of the photoreceptor belt.

The process cartridge of the present invention, which includes at least an image bearing member, and a developing device configured to develop an electrostatic latent image on the image bearing member with the developer of the present invention, which devices are unitized. The process cartridge can further include other devices such as a charging device configured to charge the image bearing member, and a cleaning device configured clean the surface of the image bearing member. The process cartridge can be detachably attached to an image forming apparatus.

Figure 6:
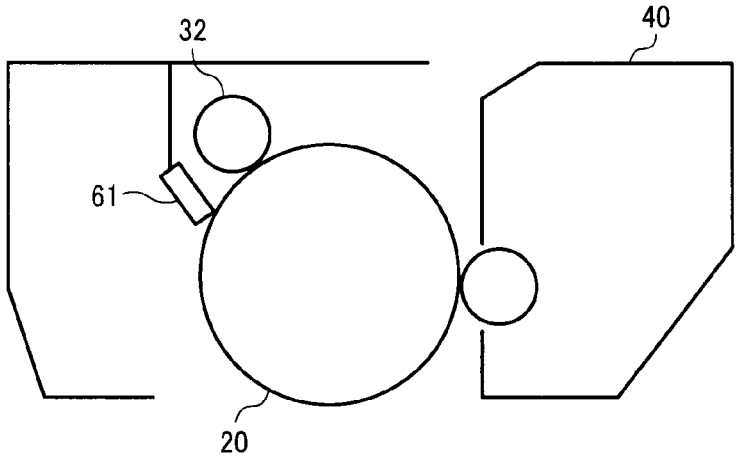
FIG. 6 is a schematic view illustrating an example of the process cartridge of the present invention.

FIG. 6 illustrates an example of the process cartridge of the present invention. The process cartridge uses the carrier (developer) of the present invention. Referring to FIG. 6, the process cartridge includes the image bearing member (photoreceptor drum) 20, a charger (such as brush-form contact-type chargers) serving as the charging device 32, the developing device 40 containing the developer of the present invention, and the cleaning blade 61 serving as the cleaning device. These devices are unitized. The process cartridge is detachably attachable to a main body of an image forming apparatus such as copiers and printers.

It is preferable to supply the developer (i.e., supplementary developer) of the present invention, which includes the carrier of the present invention and a toner, to an image forming apparatus which performs image formation while discharging used developer (excessive developer) in the developing device. In this case, high quality images can be stably produced for an extremely long period of time. Namely, by replacing part of the used (deteriorated) carrier in the used developer contained in the developing device with fresh carrier included in the supplementary developer, the initial properties (such as toner charging ability) of the carrier can be stably maintained for a long period of time, resulting in maintenance of the high image qualities. This image forming method can be preferably used when producing images with high image area proportion. Specifically, when producing images with high image area proportion, the spent toner problem tends to be easily caused, and thereby the charging ability of the carrier is deteriorated. By using this image forming method, the amount of the supplementary developer supplied to the developing device to replace part of the used developer with the supplementary developer increases when images with high image area proportion are produced because the amount of toner used for development increases. Namely, the chance that the deteriorated carrier is replaced with the fresh carrier increases. Therefore, high quality images can be stably produced for an extremely long period of time.

The weight ratio (C/T) of the carrier (C) to the toner (T) in the supplementary developer is 1/2 to 1/50. When the ratio of the toner is too small, the content of the carrier in the developer increases, resulting in excessive increase of the charge quantity of the developer (toner). When the charge quantity of the developer excessively increases, the developing ability of the developer deteriorates, resulting in decrease of the image density. In contrast, when the ratio of the toner is too large, the content of the carrier in the developer decreases, and thereby the chance that the deteriorated carrier is replaced with the fresh carrier decreases. In this case, the effect of preventing deterioration of the carrier is hardly produced.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Resin Synthesis Examples

Synthesis of Resins (Copolymers)

In the below-mentioned resin synthesis examples, the weight average molecular weight of a resin is the polystyrene-conversion molecular weight determined using gel permeation chromatography (GPC). The viscosity of a resin is measured at 25° C. by the method defined in JIS-K2283. In addition, the content of non-volatile components in a coating liquid including a resin is determined by a method in which one gram of the coating liquid is put on an aluminum plate, and the coating liquid is heated for one hour at 150° C., wherein the content of non-volatile components (C) is obtained by the following equation:

$$C(\%)=Wa\times 100/Wb$$

wherein Wb represents the weight of the coating liquid before heating, and Wa represents the weight of the coating liquid after heating.

Resin Synthesis Example 1

At first, 300 parts of toluene was fed into a flask equipped with an agitator. The flask was heated to 90° C. under a nitrogen gas flow. Next, a mixture of the following components was dropped into the flask over 1 hour.

| | |
|---|---|
| 3-Methacryloxypropyltris-(trimethylsiloxy)silane ($CH_2$═CMe—COO—$C_3H_6$—Si($OSiMe_3$)$_3$, SILAPLANE TM-0701T from Chisso Corp.) | 84.4 g (200 mmole) |
| 3-Methacryloxypropyltrimethoxysilane | 37.2 g (150 mmole) |
| Methyl methacrylate | 65.0 g (650 mmole) |
| 2,2-azobis-2-methylbutylonitrile | 0.58 g (3 mmole) |

In addition, a solution of 2,2-azobis-2-methylbutylonitrile which had been prepared by dissolving 0.06 g (0.3 mmole) of 2,2-azobis-2-methylbutylonitrile in 15 g of toluene was fed into the flask. The mixture was heated for 3 hours in a temperature range of from 90 to 100° C. to perform a radical polymerization reaction. Thus, a solution of a methacrylic copolymer (resin 1) was prepared.

The weight average molecular weight of the methacrylic copolymer was 34,000.

The solution was diluted with toluene so that the content of non-volatile components in the solution is 25% by weight. The viscosity of the diluted solution of the methacrylic copolymer was 8.7 $mm^2/s$, and the specific gravity thereof was 0.91.

Resin Synthesis Example 2

The procedure for preparation of the methacrylic copolymer solution in Resin Synthesis Example 1 was repeated except that 37.2 g of 3-methacryloxypropyltrimethoxysilane was replaced with 39 g (150 mmole) of 3-methacryloxypropylmethyldiethoxysilane.

The weight average molecular weight of the thus prepared methacrylic copolymer (resin 2) was 33,000.

The solution was diluted with toluene so that the content of non-volatile components in the solution is 25% by weight. The viscosity of the diluted solution of the methacrylic copolymer was 8.8 $mm^2/s$, and the specific gravity thereof was 0.91.

Resin Synthesis Example 3

At first, 300 parts of toluene was fed into a flask equipped with an agitator. The flask was heated to 90° C. under a nitrogen gas flow. Next, a mixture of the following components was dropped into the flask over 1 hour.

| | |
|---|---|
| 3-Methacryloxypropyltris-(trimethylsiloxy)silane ($CH_2$═CMe—COO—$C_3H_6$—Si($OSiMe_3$)$_3$, SILAPLANE TM-0701T from Chisso Corp.) | 33.8 g (80 mmole) |
| 3-Methacryloxypropyltrimethoxysilane | 37.2 g (150 mmole) |
| Methyl methacrylate | 77.0 g (770 mmole) |
| 2,2-azobis-2-methylbutylonitrile | 0.58 g (3 mmole) |

In addition, a solution of 2,2-azobis-2-methylbutylonitrile which had been prepared by dissolving 0.06 g (0.3 mmole) of 2,2-azobis-2-methylbutylonitrile in 15 g of toluene was fed into the flask. The mixture was heated for 3 hours in a temperature range of from 90 to 100° C. to perform a radical polymerization reaction. Thus, a solution of a methacrylic copolymer (resin 3) was prepared.

The weight average molecular weight of the methacrylic copolymer was 36,000.

The solution was diluted with toluene so that the content of non-volatile components in the solution is 25% by weight. The viscosity of the diluted solution of the methacrylic copolymer was 8.8 $mm^2/s$, and the specific gravity thereof was 0.90.

Resin Synthesis Example 4

At first, 400 parts of toluene was fed into a flask equipped with an agitator. The flask was heated to 90° C. under a nitrogen gas flow. Next, a mixture of the following components was dropped into the flask over 1 hour.

| | |
|---|---|
| 3-Methacryloxypropyltris-(trimethylsiloxy)silane ($CH_2$═CMe—COO—$C_3H_6$—Si($OSiMe_3$)$_3$, SILAPLANE TM-0701T from Chisso Corp.) | 181.5 g (430 mmole) |
| 3-Methacryloxypropyltrimethoxysilane | 37.2 g (150 mmole) |
| Methyl methacrylate | 42.0 g (420 mmole) |
| 2,2-azobis-2-methylbutylonitrile | 0.58 g (3 mmole) |

In addition, a solution of 2,2-azobis-2-methylbutylonitrile which had been prepared by dissolving 0.06 g (0.3 mmole) of 2,2-azobis-2-methylbutylonitrile in 15 g of toluene was fed into the flask. The mixture was heated for 3 hours in a temperature range of from 90 to 100° C. to perform a radical polymerization reaction. Thus, a solution of a methacrylic copolymer (resin 4) was prepared.

The weight average molecular weight of the methacrylic copolymer was 38,000.

The solution was diluted with toluene so that the content of non-volatile components in the solution is 25% by weight. The viscosity of the diluted solution of the methacrylic copolymer was 8.8 $mm^2/s$, and the specific gravity thereof was 0.92.

Resin Synthesis Example 5

At first, 250 parts of toluene was fed into a flask equipped with an agitator. The flask was heated to 90° C. under a nitrogen gas flow. Next, a mixture of the following components was dropped into the flask over 1 hour.

| | |
|---|---|
| 3-Methacryloxypropyltris-(trimethylsiloxy)silane ($CH_2$═CMe—COO—$C_3H_6$—Si($OSiMe_3$)$_3$, SILAPLANE TM-0701T from Chisso Corp.) | 12.7 g (30 mmole) |
| 3-Methacryloxypropyltrimethoxysilane | 49.6 g (200 mmole) |
| Methyl methacrylate | 77.0 g (770 mmole) |
| 2,2-azobis-2-methylbutylonitrile | 0.58 g (3 mmole) |

In addition, a solution of 2,2-azobis-2-methylbutylonitrile which had been prepared by dissolving 0.06 g (0.3 mmole) of 2,2-azobis-2-methylbutylonitrile in 15 g of toluene was fed to the flask. The mixture was heated for 3 hours in a temperature range of from 90 to 100° C. to perform a radical polymerization reaction. Thus, a solution of a methacrylic copolymer (resin 5) was prepared.

The weight average molecular weight of the methacrylic copolymer was 34,000.

The solution was diluted with toluene so that the content of non-volatile components in the solution is 25% by weight. The viscosity of the diluted solution of the methacrylic copolymer was 8.6 $mm^2/s$, and the specific gravity thereof was 0.91.

Resin Synthesis Example 6

At first, 250 parts of toluene was fed into a flask equipped with an agitator. The flask was heated to 90° C. under a nitrogen gas flow. Next, a mixture of the following components was dropped into the flask over 1 hour.

| | |
|---|---|
| 3-Methacryloxypropyltrimethoxysilane | 57.0 g (230 mmole) |
| Methyl methacrylate | 77.0 g (770 mmole) |
| 2,2-azobis-2-methylbutylonitrile | 0.58 g (3 mmole) |

In addition, a solution of 2,2-azobis-2-methylbutylonitrile which had been prepared by dissolving 0.06 g (0.3 mmole) of 2,2-azobis-2-methylbutylonitrile in 15 g of toluene was fed into the flask. The mixture was heated for 3 hours in a temperature range of from 90 to 100° C. to perform a radical polymerization reaction. Thus, a solution of a methacrylic copolymer (resin 6) was prepared.

The weight average molecular weight of the methacrylic copolymer was 39,000.

The solution was diluted with toluene so that the content of non-volatile components in the solution is 25% by weight. The viscosity of the diluted solution of the methacrylic copolymer was 8.9 $mm^2/s$, and the specific gravity thereof was 0.90.

Resin Synthesis Example 7

At first, 350 parts of toluene was fed into a flask equipped with an agitator. The flask was heated to 90° C. under a nitrogen gas flow. Next, a mixture of the following components was dropped into the flask over 1 hour.

| | |
|---|---|
| 3-Methacryloxypropyltris-(trimethylsiloxy)silane ($CH_2$═CMe—COO—$C_3H_6$—Si($OSiMe_3$)$_3$, SILAPLANE TM-0701T from Chisso Corp.) | 63.3 g (150 mmole) |
| 3-Methacryloxypropyltrimethoxysilane | 111.6 g (450 mmole) |
| Methyl methacrylate | 40.0 g (400 mmole) |
| 2,2-azobis-2-methylbutylonitrile | 0.58 g (3 mmole) |

In addition, a solution of 2,2-azobis-2-methylbutylonitrile which had been prepared by dissolving 0.06 g (0.3 mmole) of 2,2-azobis-2-methylbutylonitrile in 15 g of toluene was fed into the flask. The mixture was heated for 3 hours in a temperature range of from 90 to 100° C. to perform a radical polymerization reaction. Thus, a solution of a methacrylic copolymer (resin 7) was prepared.

The weight average molecular weight of the methacrylic copolymer was 37,000.

The solution was diluted with toluene so that the content of non-volatile components in the solution is 25% by weight. The viscosity of the diluted solution of the methacrylic copolymer was 8.6 $mm^2/s$, and the specific gravity thereof was 0.91.

Resin Synthesis Example 8

At first, 350 parts of toluene was fed into a flask equipped with an agitator. The flask was heated to 90° C. under a nitrogen gas flow. Next, a mixture of the following components was dropped into the flask over 1 hour.

| | |
|---|---|
| 3-Methacryloxypropyltris-(trimethylsiloxy)silane ($CH_2$═CMe—COO—$C_3H_6$—Si($OSiMe_3$)$_3$, SILAPLANE TM-0701T from Chisso Corp.) | 84.4 g (200 mmole) |
| 3-Methacryloxypropyltrimethoxysilane | 12.4 g (50 mmole) |
| Methyl methacrylate | 75.0 g (750 mmole) |
| 2,2-azobis-2-methylbutylonitrile | 0.58 g (3 mmole) |

In addition, a solution of 2,2-azobis-2-methylbutylonitrile which had been prepared by dissolving 0.06 g (0.3 mmole) of 2,2-azobis-2-methylbutylonitrile in 15 g of toluene was fed into the flask. The mixture was heated for 3 hours in a temperature range of from 90 to 100° C. to perform a radical polymerization reaction. Thus, a solution of a methacrylic copolymer (resin 8) was prepared.

The weight average molecular weight of the methacrylic copolymer was 34,000.

The solution was diluted with toluene so that the content of non-volatile components in the solution is 25% by weight. The viscosity of the diluted solution of the methacrylic copolymer was 8.7 $mm^2/s$, and the specific gravity thereof was 0.90.

Resin Synthesis Example 9

At first, 350 parts of toluene was fed into a flask equipped with an agitator. The flask was heated to 90° C. under a nitrogen gas flow. Next, a mixture of the following components was dropped into the flask over 1 hour.

| | |
|---|---|
| 3-Methacryloxypropyltris-(trimethylsiloxy)silane ($CH_2$═CMe—COO—$C_3H_6$—Si($OSiMe_3$)$_3$, SILAPLANE TM-0701T from Chisso Corp.) | 105.5 g (250 mmole) |
| Methyl methacrylate | 75.0 g (750 mmole) |
| 2,2-azobis-2-methylbutylonitrile | 0.58 g (3 mmole) |

In addition, a solution of 2,2-azobis-2-methylbutylonitrile which had been prepared by dissolving 0.06 g (0.3 mmole) of 2,2-azobis-2-methylbutylonitrile in 15 g of toluene was fed into the flask. The mixture was heated for 3 hours in a temperature range of from 90 to 100° C. to perform a radical polymerization reaction. Thus, a solution of a methacrylic copolymer (resin 9) was prepared.

The weight average molecular weight of the methacrylic copolymer was 39,000.

The solution was diluted with toluene so that the content of non-volatile components in the solution is 25% by weight. The viscosity of the diluted solution of the methacrylic copolymer was 8.8 $mm^2/s$, and the specific gravity thereof was 0.92.

Resin Synthesis Example 10

At first, 100 parts of methyl ethyl ketone was fed into a 500-ml flask equipped with an agitator, a condenser, a thermometer, a nitrogen feed pipe, and a dropping device.

Next, the following components were dissolved in 100 pats of methyl ethyl ketone at 80° C. to prepare a solution.

| | |
|---|---|
| Methyl methacrylate (MMA) | 32.6 parts |
| 2-Hydroxyethyl methacrylate (HEMA) | 2.5 parts |
| Organopolysiloxane-1:3-methacryloxypropyl-Tris(trimethylsiloxy)silane (MPTS) | 64.9 parts |
| 1,1'-azobis(cyclohexane-1-carbonitrile)) (V-40 from Wako Pure Chemical Industries, Ltd.) | 1 part |

The thus prepared solution was dropped into the flask heated to 80° C. under nitrogen gas flow over 2 hours, and the mixture (reaction product) was aged for 5 hours. Thus, a solution of a methacrylic copolymer (resin 10) was prepared. The methacrylic copolymer solution was diluted with methyl ethyl ketone so as to include non-volatile components in an amount of 25% by weight.

Resin Synthesis Example 11

At first, 250 parts of toluene was fed into a flask equipped with an agitator. The flask was heated to 90° C. under a nitrogen gas flow. Next, a mixture of the following components was dropped into the flask over 1 hour.

| | |
|---|---|
| 3-Methacryloxypropyltris-(trimethylsiloxy)silane ($CH_2$═CMe—COO—$C_3H_6$—Si($OSiMe_3$)$_3$, SILAPLANE TM-0701T from Chisso Corp.) | 25.3 g (60 mmole) |
| 3-Methacryloxypropyltrimethoxysilane | 14.9 g (60 mmole) |
| Methyl methacrylate | 88.0 g (880 mmole) |
| 2,2-azobis-2-methylbutylonitrile | 0.58 g (3 mmole) |

In addition, a solution of 2,2-azobis-2-methylbutylonitrile which had been prepared by dissolving 0.06 g (0.3 mmole) of 2,2-azobis-2-methylbutylonitrile in 15 g of toluene was fed into the flask. The mixture was heated for 3 hours in a temperature range of from 90 to 100° C. to perform a radical polymerization reaction. Thus, a solution of a methacrylic copolymer (resin 11) was prepared.

The weight average molecular weight of the methacrylic copolymer was 32,000.

The solution was diluted with toluene so that the content of non-volatile components in the solution is 25% by weight. The viscosity of the diluted solution of the methacrylic copolymer was 8.9 $mm^2/s$, and the specific gravity thereof was 0.90.

Resin Synthesis Example 12

At first, 450 parts of toluene was fed into a flask equipped with an agitator. The flask was heated to 90° C. under a nitrogen gas flow. Next, a mixture of the following components was dropped into the flask over 1 hour.

| | |
|---|---|
| 3-Methacryloxypropyltris-(trimethylsiloxy)silane ($CH_2$═CMe—COO—$C_3H_6$—Si($OSiMe_3$)$_3$, SILAPLANE TM-0701T from Chisso Corp.) | 156.1 g (370 mmole) |
| 3-Methacryloxypropyltrimethoxysilane | 94.2 g (380 mmole) |
| Methyl methacrylate | 25.0 g (250 mmole) |
| 2,2-azobis-2-methylbutylonitrile | 0.58 g (3 mmole) |

In addition, a solution of 2,2-azobis-2-methylbutylonitrile which had been prepared by dissolving 0.06 g (0.3 mmole) of 2,2-azobis-2-methylbutylonitrile in 15 g of toluene was fed into the flask. The mixture was heated for 3 hours in a temperature range of from 90 to 100° C. to perform a radical polymerization reaction. Thus, a solution of a methacrylic copolymer (resin 12) was prepared.

The weight average molecular weight of the methacrylic copolymer was 39,000.

The solution was diluted with toluene so that the content of non-volatile components in the solution is 25% by weight. The viscosity of the diluted solution of the methacrylic copolymer was 9.0 $mm^2/s$, and the specific gravity thereof was 0.92.

Resin Synthesis Example 13

At first, 500 parts of toluene was fed into a flask equipped with an agitator. The flask was heated to 90° C. under a nitrogen gas flow. Next, a mixture of the following components was dropped into the flask over 1 hour.

| | |
|---|---|
| 3-Methacryloxypropyltris-(trimethylsiloxy)silane ($CH_2$=CMe—COO—$C_3H_6$—Si($OSiMe_3$)$_3$, SILAPLANE TM-0701T from Chisso Corp.) | 211 g (500 mmole) |
| 3-Methacryloxypropyltrimethoxysilane | 124.0 g (500 mmole) |
| 2,2-azobis-2-methylbutylonitrile | 0.58 g (3 mmole) |

In addition, a solution of 2,2-azobis-2-methylbutylonitrile which had been prepared by dissolving 0.06 g (0.3 mmole) of 2,2-azobis-2-methylbutylonitrile in 15 g of toluene was fed into the flask. The mixture was heated for 3 hours in a temperature range of from 90 to 100° C. to perform a radical polymerization reaction. Thus, a solution of a methacrylic copolymer (resin 13) was prepared.

The weight average molecular weight of the methacrylic copolymer was 35,000.

The solution was diluted with toluene so that the content of non-volatile components in the solution is 25% by weight. The viscosity of the diluted solution of the methacrylic copolymer was 8.5 $mm^2/s$, and the specific gravity thereof was 0.92.

Carrier Preparation Example 1

Toluene was added to a mixture of 100 parts of the methacrylic copolymer solution prepared in Resin Synthesis Example 1 and 4 parts of zirconium tetraacetylacetonate serving as a catalyst so that the diluted solution has a solid content of 10% by weight. Thus, a resin layer coating liquid was prepared.

The above-prepared resin layer coating liquid was applied to a particulate Mn ferrite serving as a core material and having a weight average particle diameter Dw of 59.0 μm, followed by drying at 70° C., using a fluidized bed coating device so that the dried resin layer formed on the ferrite has an average thickness of 0.20 μm.

The coated carrier was heated for 2 hours at 180° C. using an electric furnace. Thus, a carrier A was prepared. The volume resistivity (Log (RΩ·cm)) and magnetization density of the carrier A were 15.5 and 62 emu/g, respectively.

Carrier Preparation Example 2

The procedure for preparation of the carrier A was repeated except that the methacrylic copolymer solution prepared in Resin Synthesis Example 1 was replaced with the methacrylic copolymer solution prepared in Resin Synthesis Example 2.

Thus, a carrier B was prepared.

Carrier Preparation Example 3

The procedure for preparation of the carrier A was repeated except that the methacrylic copolymer solution prepared in Resin Synthesis Example 1 was replaced with the methacrylic copolymer solution prepared in Resin Synthesis Example 3.

Thus, a carrier C was prepared.

Carrier Preparation Example 4

The procedure for preparation of the carrier A was repeated except that the methacrylic copolymer solution prepared in Resin Synthesis Example 1 was replaced with the methacrylic copolymer solution prepared in Resin Synthesis Example 4.

Thus, a carrier D was prepared.

Carrier Preparation Example 5

The procedure for preparation of the carrier A was repeated except that the methacrylic copolymer solution prepared in Resin Synthesis Example 1 was replaced with the methacrylic copolymer solution prepared in Resin Synthesis Example 5.

Thus, a carrier E was prepared.

Carrier Preparation Example 6

The procedure for preparation of the carrier A was repeated except that the methacrylic copolymer solution prepared in Resin Synthesis Example 1 was replaced with the methacrylic copolymer solution prepared in Resin Synthesis Example 6.

Thus, a carrier F was prepared.

Carrier Preparation Example 7

The procedure for preparation of the carrier A was repeated except that the methacrylic copolymer solution prepared in Resin Synthesis Example 1 was replaced with the methacrylic copolymer solution prepared in Resin Synthesis Example 7.

Thus, a carrier G was prepared.

Carrier Preparation Example 8

The procedure for preparation of the carrier A was repeated except that the methacrylic copolymer solution prepared in Resin Synthesis Example 1 was replaced with the methacrylic copolymer solution prepared in Resin Synthesis Example 8.

Thus, a carrier H was prepared.

Carrier Preparation Example 9

The procedure for preparation of the carrier A was repeated except that the methacrylic copolymer solution prepared in Resin Synthesis Example 1 was replaced with the methacrylic copolymer solution prepared in Resin Synthesis Example 9.

Thus, a carrier I was prepared.

Carrier Preparation Example 10

A crosslinking agent, a trimethylolpropane adduct of isophoronediisocyanate, which includes isocyanate groups (NCO) in an amount of 6.1%, was added to the methacrylic copolymer solution prepared in Resin Synthesis Example 10 in an amount such that the molar ratio (OH/NCO) of the OH groups (OH) included in the copolymer to the NCO groups included in the crosslinking agent is 1/1. Next, the mixture was diluted with methyl ethyl ketone so as to have a solid content of 3% by weight to prepare a resin layer coating liquid.

The above-prepared resin layer coating liquid was applied to a particulate ferrite serving as a core material and having a weight average particle diameter Dw of 59.0 μm, followed by drying at 70° C., using a fluidized bed coating device so that the dried resin layer formed on the ferrite has an average thickness of 0.20 μm.

The coated carrier was baked for 2 hours at 180° C. using an electric furnace. Thus, a carrier J was prepared. The volume resistivity (Log R (Ω·cm)) and magnetization density of the carrier J were 15.7 and 62 emu/g, respectively.

Carrier Preparation Example 11

The procedure for preparation of the carrier A was repeated except that the methacrylic copolymer solution prepared in Resin Synthesis Example 1 was replaced with the methacrylic copolymer solution prepared in Resin Synthesis Example 11.

Thus, a carrier K was prepared.

Carrier Preparation Example 12

The procedure for preparation of the carrier A was repeated except that the methacrylic copolymer solution prepared in Resin Synthesis Example 1 was replaced with the methacrylic copolymer solution prepared in Resin Synthesis Example 12.

Thus, a carrier L was prepared.

Carrier Preparation Example 13

The procedure for preparation of the carrier A was repeated except that the methacrylic copolymer solution prepared in Resin Synthesis Example 1 was replaced with the methacrylic copolymer solution prepared in Resin Synthesis Example 13.

Thus, a carrier M was prepared.

Carrier Preparation Example 14

The procedure for preparation of the carrier A was repeated except that 30 parts of a solution of a methyl silicone resin, which had been obtained from di- or tri-functional monomers and which has a weight average molecular weight of 15,000 and a solid content of 25%, was also added to the coating liquid.

Thus, a carrier N was prepared.

Carrier Preparation Example 15

The procedure for preparation of the carrier A was repeated except that the heating temperature was changed from 180° C. to 100° C.

Thus, a carrier O was prepared.

Carrier Preparation Example 16

The procedure for preparation of the carrier A was repeated except that the heating temperature was changed from 180° C. to 320° C.

Thus, a carrier P was prepared.

Carrier Preparation Example 17

The procedure for preparation of the carrier A was repeated except that the core material was replaced with a particulate Mn ferrite having a weight average particle diameter of 29.6 μm.

Thus, a carrier Q was prepared.

Carrier Preparation Example 18

Toluene was added to a mixture of 100 parts of the methacrylic copolymer solution prepared in Resin Synthesis Example 1, 200 parts of an electroconductive tin oxide having an weight average particle diameter of 0.2 μm, and 4 parts of zirconium tetraacetylacetonate serving as a catalyst so that the diluted solution has a solid content of 10% by weight. Thus, a resin layer coating liquid was prepared.

The above-prepared coating liquid was applied to a particulate Mn ferrite serving as a core material and having a weight average particle diameter Dw of 59.0 μm, followed by drying at 70° C., using a fluidized bed coating device so that the dried resin layer formed on the ferrite has an average thickness of 0.50 μm.

The coated carrier was heated for 2 hours at 180° C. using an electric furnace. Thus, a carrier A was prepared. The volume resistivity (Log (RΩ·cm)) and magnetization density of the carrier A were 13.1 and 60 emu/g, respectively.

Toner Preparation Example 1

The following components were mixed using a HENSCHEL MIXER mixer.

| | |
|---|---|
| Polyester resin serving as binder resin (Weight average molecular weight (Mw) of 18,000, number average molecular weight (Mn) of 4,000, glass transition temperature (Tg) of 59° C., and softening point of 120° C.) | 100 parts |
| Carnauba wax serving as release agent | 5 parts |
| Carbon black serving as colorant (#44 from Mitsubishi Chemical Corp.) | 10 parts |
| Fluorine-containing quaternary ammonium salt | 4 parts |

The mixture was subjected to a melt-kneading treatment using a double-axis extruder, followed by roll cooling. The cooled kneaded mixture was then crushed using a cutter mill. The cut mixture was pulverized using a jet air pulverizer, followed by classification using an air classifier. Thus, a toner (mother toner) having a weight average particle diameter of 7.4 μm was prepared.

Next, 1.0 part of a hydrophobized silica (R972 from Nippon Aerosil Co., Ltd.) was mixed with 100 parts of the above-prepared mother toner, and the mixture was mixed using a HENSCHEL MIXER mixer.

Thus, a toner 1 was prepared.

Toner Preparation Example 2

The procedure for preparation of the toner 1 was repeated except that the weight average particle diameter of the mother toner was changed to 5.2 μm, and the added amount of the hydrophobized silica R972 was changed to 1.42 parts.

Thus, a toner 2 was prepared.

Example 1

The following components were mixed for 20 minutes using a ball mill to prepare a developer of Example 1.

| | |
|---|---|
| Carrier A prepared above | 100 parts |
| Toner 1 | 7.0 parts |

The initial charge quantity of the developer was 35 μC/g, and the amount of the developer drawn to the developing sleeve was 45 mg/cm$^2$.

Several images (initial images) were produced using the developer, which was set in an image forming apparatus, IMAGIO COLOR 4000 from Ricoh Co., Ltd., to evaluate the initial image qualities.

In addition, after the developer was set to the image forming apparatus, and agitated for 10 minutes, a running test in which 100,000 monochrome copies of an original document with image area proportion of 7% are continuously produced was performed.

The image forming conditions and the detailed evaluation methods will be explained later.

Example 2

The procedure for preparation and evaluation of the developer in Example 1 was repeated except that the carrier A was replaced with the carrier B as illustrated in Table 1.

Comparative Example 1

The procedure for preparation and evaluation of the developer in Example 1 was repeated except that the carrier A was replaced with the carrier C as illustrated in Table 1.

Comparative Example 2

The procedure for preparation and evaluation of the developer in Example 1 was repeated except that the carrier A was replaced with the carrier D as illustrated in Table 1.

Comparative Example 3

The procedure for preparation and evaluation of the developer in Example 1 was repeated except that the carrier A was replaced with the carrier E as illustrated in Table 1.

Comparative Example 4

The procedure for preparation and evaluation of the developer in Example 1 was repeated except that the carrier A was replaced with the carrier F as illustrated in Table 1.

Comparative Example 5

The procedure for preparation and evaluation of the developer in Example 1 was repeated except that the carrier A was replaced with the carrier G as illustrated in Table 1.

Comparative Example 6

The procedure for preparation and evaluation of the developer in Example 1 was repeated except that the carrier A was replaced with the carrier H as illustrated in Table 1.

Comparative Example 7

The procedure for preparation and evaluation of the developer in Example 1 was repeated except that the carrier A was replaced with the carrier I as illustrated in Table 1.

Comparative Example 8

The procedure for preparation and evaluation of the developer in Example 1 was repeated except that the carrier A was replaced with the carrier J as illustrated in Table 1.

Comparative Example 9

The procedure for preparation and evaluation of the developer in Example 1 was repeated except that the carrier A was replaced with the carrier K as illustrated in Table 1.

Comparative Example 10

The procedure for preparation and evaluation of the developer in Example 1 was repeated except that the carrier A was replaced with the carrier L as illustrated in Table 1.

Comparative Example 11

The procedure for preparation and evaluation of the developer in Example 1 was repeated except that the carrier A was replaced with the carrier M as illustrated in Table 1.

Example 3

The procedure for preparation and evaluation of the developer in Example 1 was repeated except that the carrier A was replaced with the carrier N as illustrated in Table 1.

Comparative Example 12

The procedure for preparation and evaluation of the developer in Example 1 was repeated except that the carrier A was replaced with the carrier O as illustrated in Table 1.

Comparative Example 13

The procedure for preparation and evaluation of the developer in Example 1 was repeated except that the carrier A was replaced with the carrier P as illustrated in Table 1.

Example 4

The procedure for preparation and evaluation of the developer in Example 1 was repeated except that the carrier A was replaced with the carrier Q having a weight average particle diameter of 30.2 μm as illustrated in Table 1 and the added amount of the toner 1 was changed from 7 parts to 10 parts by weight.

Example 5

The procedure for preparation and evaluation of the developer in Example 1 was repeated except that the carrier A was replaced with the carrier R as illustrated in Table 1.

Example 6

The procedure for preparation and evaluation of the developer in Example 1 was repeated except that the toner 1 was replaced with 5 parts of the toner 2 as illustrated in Table 1.

Example 7

The procedure for preparation and evaluation of the developer in Example 1 were repeated except that when images were formed, the development bias was changed from a DC voltage of −500V superimposed with an AC voltage to a DC voltage of −500V (i.e., AC voltage is not superimposed).

Example 8

The procedure for preparation and evaluation of the developer in Example 6 was repeated except that the running test was performed while supplying a supplementary developer, which is a mixture of 1 part of the developer of Example 6 and 10 parts of the toner 2, to the image forming apparatus IMAGIO COLOR 4000 and the original document to be reproduced in the 100,000 copy running test was changed to an original document having image area proportion of 50%. Since the amount of the developer in the running test increased because the supplementary developer was supplied, the excessive developer was overflowed from the rear side of the developing device to be collected. After the running test, the same evaluation as performed in Example 1 was also performed.

Comparative Example 14

The procedure for preparation and evaluation of the developer in Example 6 was repeated except that the original document to be reproduced in the 100,000 copy running test was changed to the original document having image area proportion of 50%. Namely, unlike Example 8, the running test was performed without supplying the supplementary developer to the image forming apparatus.

Evaluation of the developers is performed as follows.

I. Evaluation of Initial Image Qualities and Image Qualities after the Running Test The initial image forming operation, the after-running test image forming operation, and the running test were performed using a digital image forming apparatus, IMAGIO COLOR 4000 (multifunctional image forming apparatus having copier and printer functions) from Ricoh Co., Ltd. The developing conditions were as follows.

Development gap (i.e., gap between the surface of the photoreceptor and the surface of the developing sleeve): 0.3 mm Doctor gap (gap between the tip of the doctor blade and the surface of the developing sleeve): 0.65 mm Linear speed of the photoreceptor: 200 mm/sec Ratio (d/p) of linear speed (d) of the developing sleeve to linear speed (p) of the photoreceptor: 1.80

Dot density of written dot image: 600 dpi

Potential (Vd) of non-irradiated portion (background area) of electrostatic latent image: −600V Potential (Vi) of irradiated portion (image area) of electrostatic latent image: −100V Development bias: Combination of DC (−500V) and AC having voltage of from −100 to −900V, frequency of 2 KHz and duty of 50%

Images formed on the receiving material were visually observed to evaluate the image qualities mentioned below.

In addition, a toner image formed on the surface of the photoreceptor was transferred onto an adhesive tape, and the adhesive tape bearing the toner image was visually observed to determine whether the toner image includes particles of the carrier used (i.e., to determine whether the carrier adhesion problem is caused).

The evaluation items and evaluation methods are as follows.

1. Physical Properties of Developer (1) Variation of Amount of Developer Drawn to Developing Sleeve Variation (V) of the amount of the developer drawn to the developing sleeve is defined by the following equation:

$$V(\%)=100\times\{Ai-Ar\}/Ai$$

wherein Ai represents the amount of the developer drawn to the developing sleeve (i.e., the weight of the developer on the developing sleeve) before the running test in units of $mg/cm^2$, and Ar represents the amount of the developer drawn to the developing sleeve after the running test in units of $mg/cm^2$.

This developer amount variation property of a developer is graded as follows.

Rank A (excellent): The absolute value of the variation V is less than 5%.

Rank B (good): The absolute value of the variation V is not less than 5% and less than 10%.

Rank C (usable): The absolute value of the variation V is not less than 10% and less than 20%.

Rank D (unusable): The absolute value of the variation V is not less than 20%.

(2) Amount of Spent Toner

A certain amount (W1) of a carrier used for the 100,000-copy running test is mixed with methyl ethyl ketone to remove the toner (i.e., spent toner) adhered to the surface of the carrier from the carrier. After the carrier is dried, the weight (W2) of the carrier is measured to determine the ratio R(%) of the spent toner to the carrier, wherein R(%)=100×(W1−W2)/W1.

The same test is performed on the initial carrier to determine the ratio R0(%) and the difference (R−R0) (%).

This spent toner property of a developer is graded as follows.

Rank A (excellent): The difference (R−R0) is less than 0.03%.

Rank B (good): The difference (R−R0) is not less than 0.03% and less than 0.07%.

Rank C (usable): The difference (R−R0) is not less than 0.07% and less than 0.15%.

Rank D (unusable): The difference (R−R0) is not less than 0.15%.

(3) Variation of Charge Quantity (Q/M) of the Toner Used, which is Caused by Environmental Change Variation (Vq) of the charge quantity (Q/M) of toner caused by environmental change is defined by the following equation:

$$Vq(\%)=100\times2\times\{(Q/M)_{10/15}-(Q/M)_{30/90}\}/\{(Q/M)_{10/15}+(Q/M)_{30/90}\},$$

wherein $(Q/M)_{10/15}$ represents the charge quantity of the toner under an environmental condition of 10° C. and 15% RH, and $(Q/M)_{30/90}$ represents the charge quantity of the toner under an environmental condition of 30° C. and 90% RH.

This charge quantity variation property of a developer is graded as follows.

Rank A (excellent): The charge quantity variation Vq is less than 10%.

Rank B (good): The charge quantity variation Vq is not less than 10% and less than 30%.

Rank C (usable): The charge quantity variation Vq is not less than 30% and less than 70%.

Rank D (unusable): The charge quantity variation Vq is not less than 70%.

2. Image Qualities of Developer

Qualities of images produced by a developer are evaluated as follows.

(1) Image Density of Solid Image (IDs)

The image densities of randomly selected five points of a solid image with a size of 30 mm×30 mm in an image produced by a developer are measured with a spectrophotometric densitometer X-RITE 938 from X-Rite Inc., and the five image densities are averaged to determine the average image density of the solid image.

In this regard, the potential Vi of an electrostatic latent image (irradiated portion of the photoreceptor) corresponding to the solid image is −100V, and the development potential, which is defined as the difference between (Vi (−100V)−development bias (−500V)), is 400V.

This image density property is evaluated before and after the 100,000-copy running test.

(2) Image Density of Half Tone Image (IDh)

The image densities of randomly selected five points of a half tone image with a size of 30 mm×30 mm in an image produced by a developer are measured with a spectrophotometric densitometer X-RITE 938 from X-Rite Inc., and the image densities are averaged to determine the average image density of the half tone image.

In this regard, the potential Vi' of an electrostatic latent image (irradiated portion of the photoreceptor) corresponding to the half tone image is −350V, and the development potential, which is defined as the difference between (Vi' (−350V)−development bias (−500V)), is 150V.

This half tone image density property is evaluated before and after the 100,000-copy running test.

(3) Granularity (G)

The granularity of image means evenness of a solid image. Namely, the lower the granularity of a solid image, the better the evenness of the solid image.

The granularity (G) of an image is determined by the following equation.

$$G=\exp(aL+b)\int(WS(f))^{1/2}\cdot VTF(f)df$$

wherein L represents the average lightness of a solid image, f represents the special frequency (cycle/mm), WS(f) represents the power spectrum of lightness variation, VTF(f) represents the special frequency property of eyes, and a and b are coefficients.

In this regard, the lightness of the solid image used for this evaluation is from 50 to 80%.

This granularity property of a developer is graded as follows.

Rank A (excellent): The granularity (G) is less than 0.2.

Rank B (good): The granularity (G) is not less than 0.2 and less than 0.3.

Rank C (usable): The granularity (G) is not less than 0.3 and less than 0.4.

Rank D (unusable): The granularity (G) is less than 0.4.

The granularity property is evaluated before and after the 100,000-copy running test.

(4) Background Development (BD)

An image produced by a developer is visually observed to determine whether the background of the image is soiled with toner particles.

This background development property of a developer is graded as follows.

Rank A: The developer has excellent background development property (i.e., the background is not soiled with toner).

Rank B: The developer has good background development property (i.e., the background is hardly soiled with toner).

Rank C: The developer has usable background development property (i.e., the background is slightly soiled with toner).

Rank D: The developer has unusable background development property (i.e., the background is seriously soiled with toner).

The background development property is evaluated before and after the 100,000-copy running test.

(5) Carrier Adhesion to Solid Image (CAs)

When particles of a carrier adhere to electrostatic latent images, the photoreceptor and fixing roller are damaged, thereby deteriorating the image qualities. Since all the carrier particles adhered to the photoreceptor are not transferred onto a receiving material sheet, a method in which the number of carrier particles adhered to a solid toner image with a size of 30 mm×30 mm formed on the photoreceptor of the image forming apparatus (IMAGIO COLOR 4000) is counted is used for evaluating the carrier adhesion property. In this regard, the solid toner image is produced by the following conditions.

Potential (Vd) of non-irradiated portion of photoreceptor: −600V

Potential (Vi) of irradiated portion of photoreceptor: −100V

Development bias: −500V

The solid image carrier adhesion property (CAs) is graded as follows.

Rank A: The developer has excellent solid image carrier adhesion property.

Rank B: The developer has good solid image carrier adhesion property.

Rank C: The developer has usable solid image carrier adhesion property.

Rank D: The developer has unusable solid image carrier adhesion property.

The solid image carrier adhesion property is evaluated before and after the 100,000-copy running test.

(6) Carrier Adhesion to Line Image (Edge Portion of Image) (CAl)

A two-dot line image (having a density of 100 lines/inch), which extends in the sub-scanning direction of the photoreceptor, is formed on the photoreceptor. In this regard, the line image is produced by the following conditions.

Potential (Vd) of non-irradiated portion of photoreceptor: −600V

Potential (Vi) of irradiated portion of photoreceptor: −100V

Development bias: −400V (Background Potential: 200V (i.e., 600V-400V)

The number of carrier particles adhered to the line image formed on the photoreceptor is counted after transferring the line image to an adhesive tape with a size of 100 $cm^2$.

The line image carrier adhesion property (CAl) is graded as follows.

Rank A: The developer has excellent line image carrier adhesion property.

Rank B: The developer has good line image carrier adhesion property.

Rank C: The developer has usable line image carrier adhesion property.

Rank D: The developer has unusable line image carrier adhesion property.

The line image carrier adhesion property is evaluated before and after the 100,000-copy running test.

(7) Variation of Image Density Caused by Environmental Change (V(ID))

After the 100,000-copy running test, images are produced under environmental conditions of 30° C. 90% RH and 10° C. 15% RH. Image densities of the images produced under the environmental conditions are measured to determine the difference of the image densities.

This image density variation property (V(ID)) is graded as follows.

Rank A (excellent): The image density difference is less than 0.05.

Rank B (good): The image density difference is not less than 0.05 and less than 0.15.

Rank C (usable): The image density difference is not less than 0.15 and less than 0.25.

Rank D (unusable): The image density difference is not less than 0.25.

(8) Toner Scattering (TS)

After the 100,000-copy running test, the developing device and the vicinity thereof are visually observed to determine whether the toner scatters around the developing device. In this regard, as the amount of scattered toner decreases, the developer has better toner scattering property.

The toner scattering property is graded as follows.

Rank A: The developer has excellent toner scattering property.

Rank B: The developer has good toner scattering property.

Rank C: The developer has usable toner scattering property.

Rank D: The developer has unusable toner scattering property.

The evaluation results are shown in Tables 1-4.

TABLE 1

| | | | Initial properties of carrier | | | | |
|---|---|---|---|---|---|---|---|
| | Toner used | Carrier used | Dw (μm) | M* (emu/g) | Q/M (μC/g) | Log R (Ω · cm) | Tr** (μm) |
| Ex. 1 | 1 | A | 59.5 | 62 | 35 | 15.5 | 0.20 |
| Ex. 2 | 1 | B | 59.6 | 62 | 32 | 15.6 | 0.20 |
| Comp. Ex. 1 | 1 | C | 59.5 | 62 | 30 | 15.4 | 0.19 |
| Comp. Ex. 2 | 1 | D | 59.7 | 62 | 39 | 15.7 | 0.21 |
| Comp. Ex. 3 | 1 | E | 59.6 | 62 | 28 | 15.5 | 0.20 |
| Comp. Ex. 4 | 1 | F | 59.5 | 62 | 26 | 15.6 | 0.20 |
| Comp. Ex. 5 | 1 | G | 59.6 | 62 | 33 | 15.7 | 0.20 |
| Comp. Ex. 6 | 1 | H | 59.7 | 62 | 32 | 15.7 | 0.21 |
| Comp. Ex. 7 | 1 | I | 59.5 | 62 | 37 | 15.5 | 0.20 |
| Comp. Ex. 8 | 1 | J | 59.6 | 62 | 33 | 15.5 | 0.19 |
| Comp. | 1 | K | 59.7 | 62 | 38 | 15.6 | 0.20 |

TABLE 1-continued

| | Toner used | Carrier used | Initial properties of carrier | | | | |
|---|---|---|---|---|---|---|---|
| | | | Dw (μm) | M* (emu/g) | Q/M (μC/g) | Log R (Ω · cm) | Tr** (μm) |
| Ex. 9 | | | | | | | |
| Comp. Ex. 10 | 1 | L | 59.6 | 62 | 32 | 15.5 | 0.21 |
| Comp. Ex. 11 | 1 | M | 59.5 | 62 | 27 | 15.6 | 0.20 |
| Ex. 3 | 1 | N | 59.5 | 62 | 28 | 15.8 | 0.20 |
| Comp. Ex. 12 | 1 | 0 | 59.7 | 62 | 37 | 15.7 | 0.20 |
| Comp. Ex. 13 | 1 | P | 59.6 | 62 | 31 | 14.3 | 0.20 |
| Ex. 4 | 1 | Q | 30.2 | 61 | 39 | 15.9 | 0.21 |
| Ex. 5 | 1 | R | 60.3 | 60 | 30 | 13.1 | 0.50 |
| Ex. 6 | 2 | A | 59.5 | 62 | 43 | 15.5 | 0.20 |
| Ex. 7 | 1 | A | 59.5 | 62 | 35 | 15.5 | 0.20 |
| Ex. 8 | 2 | A | 59.5 | 62 | 43 | 15.5 | 0.20 |
| Comp. Ex. 14 | 2 | A | 59.5 | 62 | 43 | 15.5 | 0.20 |

M*: Magnetic moment

Tr**: Thickness of the resin layer on the carrier

TABLE 2

| | Properties of developer and toner after running test | | | | | | |
|---|---|---|---|---|---|---|---|
| | Q/M (μC/g) | Log R (Ω · cm) | Tr (μm) | Spent toner | Variation of Q/M | Variation of Ad* | Dw(T)** (μm) |
| Ex. 1 | 34 | 15.4 | 0.19 | A | B | A | 7.4 |
| Ex. 2 | 30 | 15.5 | 0.18 | A | A | A | 7.4 |
| Comp. Ex. 1 | 14 | 16.4 | 0.21 | C | C | C | 7.4 |
| Comp. Ex. 2 | 18 | 9.3 | 0.10 | C | C | D | 7.4 |
| Comp. Ex. 3 | 12 | 16.7 | 0.22 | D | C | D | 7.4 |
| Comp. Ex. 4 | 8 | 16.9 | 0.22 | D | D | D | 7.4 |
| Comp. Ex. 5 | 25 | 15.6 | 0.20 | B | D | C | 7.4 |
| Comp. Ex. 6 | 10 | 9.2 | 0.09 | D | C | D | 7.4 |
| Comp. Ex. 7 | 8 | 8.9 | 0.07 | D | D | D | 7.4 |
| Comp. Ex. 8 | 17 | 11.1 | 0.12 | C | C | D | 7.4 |
| Comp. Ex. 9 | 9 | 9.2 | 0.11 | D | D | D | 7.4 |
| Comp. Ex. 10 | 12 | 8.8 | 0.08 | D | D | D | 7.4 |
| Comp. Ex. 11 | 11 | 8.6 | 0.07 | D | C | D | 7.4 |
| Ex. 3 | 30 | 15.2 | 0.18 | A | A | A | 7.4 |
| Comp. Ex. 12 | 13 | 9.3 | 0.08 | C | D | D | 7.4 |
| Comp. Ex. 13 | 9 | 8.6 | 0.06 | D | D | D | 7.4 |
| Ex. 4 | 37 | 15.8 | 0.21 | A | A | A | 7.4 |
| Ex. 5 | 29 | 13.0 | 0.49 | A | B | A | 7.4 |
| Ex. 6 | 40 | 15.7 | 0.21 | B | A | B | 5.2 |
| Ex. 7 | 34 | 15.4 | 0.20 | A | A | A | 7.4 |
| Ex. 8 | 35 | 15.6 | 0.19 | B | A | A | 5.2 |
| Comp. Ex. 14 | 16 | 16.0 | 0.22 | C | B | D | 5.2 |

Variation of Ad*: Variation of amount of developer drawn to developing sleeve

Dw(T)**: Weight average particle diameter of toner

TABLE 3

| | Initial image qualities | | | | | |
|---|---|---|---|---|---|---|
| | Solid image density (IDs) | Half-tone image density (IDh) | Granularity (G) | Background development (BD) | Solid image carrier Adhesion (CAs) | Line image carrier Adhesion (CAl) |
| Ex. 1 | 1.40 | 0.50 | B | B | A | B |
| Ex. 2 | 1.42 | 0.53 | B | B | A | B |
| Comp. Ex. 1 | 1.41 | 0.51 | B | B | A | B |
| Comp. Ex. 2 | 1.36 | 0.47 | B | B | A | B |
| Comp. Ex. 3 | 1.43 | 0.54 | B | B | A | B |
| Comp. Ex. 4 | 1.45 | 0.55 | B | B | A | B |
| Comp. Ex. 5 | 1.40 | 0.50 | B | B | A | B |
| Comp. Ex. 6 | 1.41 | 0.53 | B | B | A | B |
| Comp. Ex. 7 | 1.38 | 0.48 | B | B | A | B |
| Comp. Ex. 8 | 1.42 | 0.53 | B | B | A | B |
| Comp. Ex. 9 | 1.40 | 0.49 | B | B | A | B |
| Comp. Ex. 10 | 1.41 | 0.51 | B | B | A | B |
| Comp. Ex. 11 | 1.44 | 0.55 | B | B | A | B |
| Ex. 3 | 1.43 | 0.54 | B | B | A | B |
| Comp. Ex. 12 | 1.40 | 0.49 | B | B | A | B |
| Comp. Ex. 13 | 1.41 | 0.52 | B | B | A | B |
| Ex. 4 | 1.40 | 0.51 | A | B | A | B |
| Ex. 5 | 1.44 | 0.54 | A | A | A | A |
| Ex. 6 | 1.41 | 0.46 | A | B | A | B |
| Ex. 7 | 1.37 | 0.46 | A | A | A | A |
| Ex. 8 | 1.41 | 0.46 | A | B | A | B |
| Comp. Ex. 14 | 1.41 | 0.46 | A | B | A | B |

TABLE 4

| | Image qualities after 100,000-copy running test | | | | | | | |
|---|---|---|---|---|---|---|---|---|
| | IDs | IDh | G | BD | CAs | CAl | V(ID) | TS |
| Ex. 1 | 1.42 | 0.52 | B | B | A | B | B | A |
| Ex. 2 | 1.44 | 0.52 | B | B | A | B | A | A |
| Comp. Ex. 1 | 1.58 | 0.83 | D | C | C | C | C | D |
| Comp. Ex. 2 | 1.59 | 0.85 | C | D | D | D | C | D |
| Comp. Ex. 3 | 1.60 | 0.88 | D | D | C | D | D | D |
| Comp. Ex. 4 | 1.63 | 0.92 | D | D | C | D | D | D |
| Comp. Ex. 5 | 1.49 | 0.61 | B | B | B | B | D | B |
| Comp. Ex. 6 | 1.64 | 0.93 | D | D | D | D | C | D |
| Comp. Ex. 7 | 1.65 | 0.94 | D | D | D | D | D | D |
| Comp. Ex. 8 | 1.59 | 0.83 | D | C | D | C | C | C |
| Comp. Ex. 9 | 1.66 | 0.95 | D | D | D | C | C | D |
| Comp. Ex. 10 | 1.63 | 0.95 | D | D | D | D | D | D |
| Comp. Ex. 11 | 1.62 | 0.93 | D | D | D | D | D | D |
| Ex. 3 | 1.42 | 0.51 | B | B | A | B | A | A |
| Comp. Ex. 12 | 1.65 | 0.94 | D | D | D | D | D | D |

TABLE 4-continued

| | Image qualities after 100,000-copy running test | | | | | | | |
|---|---|---|---|---|---|---|---|---|
| | IDs | IDh | G | BD | CAs | CAl | V(ID) | TS |
| Comp. Ex. 13 | 1.64 | 0.95 | D | D | D | D | D | D |
| Ex. 4 | 1.39 | 0.50 | A | B | A | C | A | A |
| Ex. 5 | 1.45 | 0.53 | A | A | A | A | B | A |
| Ex. 6 | 1.43 | 0.49 | A | B | A | B | B | A |
| Ex. 7 | 1.39 | 0.47 | A | A | A | A | A | A |
| Ex. 8 | 1.44 | 0.51 | A | B | A | A | B | A |
| Comp. Ex. 14 | 1.62 | 0.84 | D | D | A | B | B | D |

It is clear from Tables 1-4 that toner hardly adheres to the carrier of the present invention; the resin layer formed on the carrier of the present invention is so tough that the resin layer is hardly abraded or released from the carrier; the carrier of the present invention hardly causes the spent toner problem; the carrier of the present invention has good charging ability; and the carrier of the present invention good durability. In addition, since the resin layer has good abrasion resistance, the resistivity of the carrier and the amount of developer drawn to the developing sleeve hardly vary. Further, the carrier of the present invention exhibits high stability to withstand environmental conditions. Furthermore, the carrier of the present invention can produce high quality images for a long period of time without causing the toner scattering problem even when the environmental conditions vary.

This document claims priority and contains subject matter related to Japanese Patent Application No. 2009-065416, filed on Mar. 18, 2009, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A carrier comprising:

a particulate core material having magnetism; and a resin layer located on a surface of the particulate core material, wherein the resin layer is prepared by forming a layer including a copolymer on the surface of the particulate core material and then subjecting the layer to a heat treatment to crosslink the layer, wherein the copolymer has the following formula (I):

formula (1)

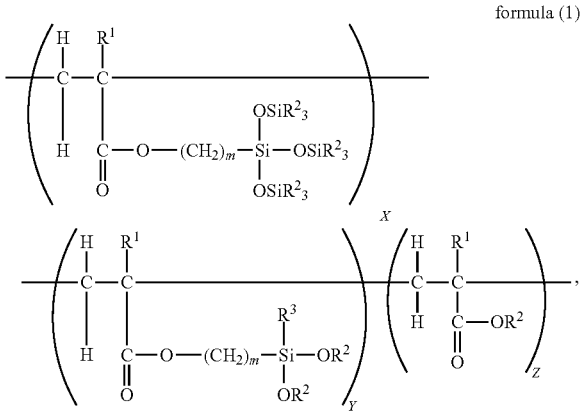

wherein $R^1$ represents a hydrogen atom or a methyl group; $(CH_2)_m$ represents an alkylene group having 1 to 8 carbon atoms; $R^2$ represents an alkyl group having 1 to 4 carbon atoms; $R^3$ represents an alkyl group having 1 to 8 carbon atoms or an alkoxyl group having 1 to 4 carbon atoms; X represents a content of a first unit and ranges from 10% by mole to 40% by mole; Y represents a content of a second unit and ranges from 10% by mole to 40% by mole; and Z represents a content of a third unit and ranges from 30% by mole to 80% by mole, wherein 60% by mole <Y+Z<90% by mole.

2. The carrier according to claim 1, wherein the resin layer is prepared by forming a layer including a copolymer having formula (1) and a silicone resin, which has a silanol group or a functional group capable of forming a silanol group by being hydrolyzed, on the surface of the magnetic core material, and then subjecting the layer to the heat treatment to crosslink the layer.

3. The carrier according to claim 1, wherein the heat treatment is performed at a temperature of from 130° C. to 300° C.

4. The carrier according to claim 1, wherein the carrier has a weight average particle diameter (Dw) of from 22 μm to 35 μm.

5. The carrier according to claim 1, wherein the resin layer includes a filler.

6. The carrier according to claim 1, wherein the carrier has a logarithmic resistivity Log R (Ω~cm) of from 10.0 to 15.0.

7. A developer for developing an electrostatic latent image, comprising:

the carrier according to claim 1; and a toner including at least a binder resin and a colorant.

8. The developer according to claim 7, wherein the toner has a weight average particle diameter of from 3.0 μm to 9.0 μm.

9. An image forming method comprising:

forming an electrostatic latent image on an image bearing member; and developing the electrostatic latent image with the developer according to claim 7 to visualize the electrostatic latent image.

10. The image forming method according to claim 9, wherein the electrostatic latent image forming step includes:

forming an electrostatic latent image on a photoreceptor, and wherein the developing step includes:

forming a layer of the developer on a developing sleeve of a developing device; and developing the electrostatic latent image on the photoreceptor with the developer layer while forming a gap of not greater than 0.4 mm between a surface of the developing sleeve and a surface of the photoreceptor and applying a DC voltage or a combination of an DC voltage and an AC voltage as a development bias to the developing sleeve.

11. The image forming method according to claim 9, further comprising:

supplying a supplementary developer to a developing device to mix the supplementary developer with the developer in the developing device while discharging an excess of the developer from the developing device, wherein the supplementary developer includes the toner and the carrier in a weight ratio (C/T) of the carrier (C) to the toner (T) of from 1/2 to 1/50.

12. A method for preparing a carrier, comprising:

forming a layer including a copolymer on a surface of a particulate core material having magnetism, wherein the copolymer has the following formula (1):

formula (1)

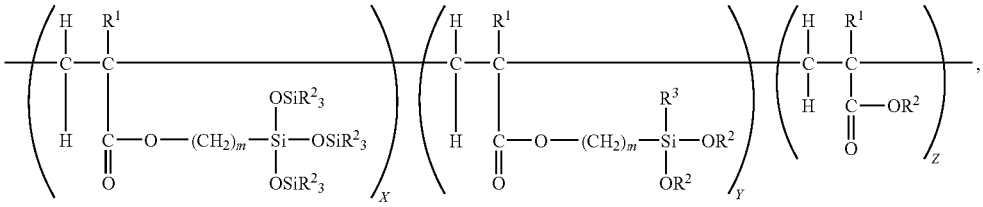

wherein $R^1$ represents a hydrogen atom or a methyl group; $(CH_2)_m$ represents an alkylene group having 1 to 8 carbon atoms; $R^2$ represents an alkyl group having 1 to 4 carbon atoms; $R^3$ represents an alkyl group having 1 to 8 carbon atoms or an alkoxyl group having 1 to 4 carbon atoms; X represents a content of a first unit and ranges from 10% by mole to 40% by mole; Y represents a content of a second unit and ranges from 10% by mole to 40% by mole; and Z represents a content of a third unit and ranges from 30% by mole to 80% by mole, wherein 60% by mole <Y+Z<90% by mole; and then subjecting the layer to a heat treatment to crosslink the layer.

* * * * *